US006116227A

United States Patent [19]

Yoshioka et al.

[11] Patent Number: 6,116,227

[45] Date of Patent: Sep. 12, 2000

[54] ENGINE AIR-FUEL RATIO CONTROLLER

[75] Inventors: Yoshiaki Yoshioka, Sagamihara; Hatsuo Nagaishi, Yokohama, both of Japan

[73] Assignee: Nissan Motor Co., Ltd., Yokohama, Japan

[21] Appl. No.: 09/008,501

[22] Filed: Jan. 16, 1998

[30] Foreign Application Priority Data

Jan. 16, 1997 [JP] Japan ..... 9-005715

[51] Int. Cl.[7] ..... F02D 41/14

[52] U.S. Cl. ..... 123/674; 701/109

[58] Field of Search ..... 123/674, 675, 123/681, 687, 698, 520; 701/109

[56] References Cited

U.S. PATENT DOCUMENTS 4,785,784 11/1988 Nanyoshi et al. ..... 123/478
5,425,349 6/1995 Nagaishi et al. ..... 123/674
5,483,945 1/1996 Kobayashi et al. ..... 123/674
5,505,184 4/1996 Uchikawa ..... 123/674

FOREIGN PATENT DOCUMENTS 64-19143 1/1989 Japan .

*Primary Examiner*—Andrew M. Dolinar
*Assistant Examiner*—Mahmoud M Gimie
*Attorney, Agent, or Firm*—Foley & Lardner

[57] ABSTRACT

A learning value of a multiplication term for correcting a basic injection amount and a learning value of an addition term for correcting the basic injection amount are stored in a memory. The learning value of the addition term is converted to a proportion relative to the basic injection amount, and these learning values are modified such that the sum of the proportion and the multiplication term lies within a predetermined range. The proportion of the total learning values relative to the basic injection amount is thereby suppressed to a constant level so that the effect of incorrect learning on air-fuel ratio control is also suppressed.

19 Claims, 23 Drawing Sheets

ENGINE AIR-FUEL RATIO CONTROLLER

The contents of Tokugan Hei 9-5715, with a filing date of Jan. 16, 1997 in Japan, are hereby incorporated by reference.

FIELD OF THE INVENTION

This invention relates to an engine air-fuel ratio controller, and in particular, to learning control of an air-fuel ratio.

BACKGROUND OF THE INVENTION

It is generally known that in air-fuel ratio control of a vehicle engine, higher efficiency of control is achieved by learning control parameters.

Tokkai Sho 64-19143 published by the Japanese Patent Office in 1989 discloses a plurality of learning values which are introduced into air-fuel ratio control. An air-fuel ratio controller according to this prior art determines an injection amount Ti by the following expressions (1) and (2). Ti is calculated as an injection pulse width of a fuel injector.

$$Tp = \frac{Qs}{N} \cdot KCONST \cdot KLCD1 \tag{1}$$

where, Tp=Basic injection pulse width,

Qs=Intake air flowrate, n=Engine rotation speed,

KCONST=Constant,

LqfKLCD1=Learning value based on flowrate characteristics of a fuel injector.

$$Ti=Tp \cdot COEF \cdot KLCD2 \cdot ALPHA+Ts+KLCD3 \tag{2}$$

where, COEF=sum of 1 and various correction coefficients,

ALPHA=air-fuel ratio feedback correction coefficient,

Ts=ineffectual pulse width,

KLCD2=learning value of ALPHA,

KLCD3=learning value of ineffectual pulse width.

Here, KLCD1 and COEF are omitted in the equations (1) and (2) in order to simplify the discussion, and the above calculation equations are rewritten by the next expressions (3), (4).

$$Tp=(Qs/n) \cdot KCONST \tag{3}$$

$$Ti=Tp \cdot KLCD2 \cdot ALPHA+Ts+KLCD3 \tag{4}$$

The ineffectual pulse width Ts is an item which compensates for response delay of the fuel injector. Even when a command signal is given to open the fuel injector for a time corresponding to Tp, the injector does not open immediately due to a response delay of the injector.

The fuel injection period is shortened by this response delay, and the fuel injection amount is correspondingly deficient. The effective injection time of the fuel injector is therefore made equal to Tp by increasing the time by Ts. The response delay of the fuel injector is normally considerably affected by the battery voltage, and the response delay increases the more the battery voltage falls. Ts is therefore set to a larger value the more the battery voltage falls.

On the other hand, the air-fuel ratio deviates from the stoichiometric air-fuel ratio when there are errors or time-dependent deterioration in the performance of the air flow meter and flowrate characteristics of the fuel injector. The deviation of the true air-fuel ratio from the stoichiometric air-fuel ratio in this case is referred to as a steady state deviation. KLCD2 has the function of canceling steady-state deviation under running conditions in which air-fuel ratio feedback control is not performed so that this control is not affected by error and time-dependent deterioration of air-fuel ratio control components.

For example, in the case where the fuel injection performance of the injector is lower than specified, the fuel injection amount is deficient and the air-fuel ratio tends towards lean. In order to restore this lean air-fuel ratio to the stoichiometric air-fuel ratio, ALPHA takes a value bigger than 100%, where 100% is the center value of ALPHA.

KLCD2 is updated based on the value of ALPHA and KLCD2 is also a coefficient having a center value of 100%, so KLCD2 will vary to a larger value than 100%. Hence when KLCD2 converges, the air-fuel ratio settles down to the stoichiometric air-fuel ratio.

Therefore even if the fuel injection performance of the injector is lower than specified, the apparent fuel injection performance of the fuel injector is equal to the specified performance.

Similarly KLCD3 is a value for eliminating the effect of error and time-dependent deterioration exerted on fuel injector opening timing.

For example, when the injector opening timing is delayed relative to the design timing, the injection amount is deficient and the air-fuel ratio of the exhaust is lean, because the delay in opening of the fuel injector results in a shorter duration of fuel injection.

To restore this lean air-fuel ratio to the stoichiometric air-fuel ratio, ALPHA varies to a value larger than 100%, and KLCD3 which is updated based on ALPHA varies to a larger value than 0 milliseconds. The center value of KLCD3 in this case is 0 milliseconds.

Hence, the air-fuel ratio settles down to the stoichiometric air-fuel ratio when KLCD3 converges.

Therefore even if the fuel injector opening timing is delayed relative to the design timing, the apparent fuel injection performance of the fuel injector is equal to the specified performance.

In the aforesaid prior apparatus, learning permission conditions were different for KLCD2 and KLCD3. In other words, whereas KLCD2 is updated for each learning region, KLCD3 is updated only in the low load area. In the low load area, the basic injection pulse width Tp is small relative to the ineffectual pulse width Ts. Therefore, the proportion of Ts error in the deviation of the air-fuel ratio from the stoichiometric air-fuel ratio in the low load region is high, and this is suitable for updating KLCD3 which is related to Ts. However in order to suppress the adverse effect of incorrect learning, i.e., a large air-fuel ratio error, it is desirable to limit each of the learning values mentioned above to within predetermined limits.

However, whereas the above-mentioned learning value KLCD1 and KLCD2 which are learning values introduced in the form of a multiplication (referred to hereafter as a multiplication term), KLCD3 is a learning value introduced in the form of an addition (referred to hereafter as an addition term). Hence, setting a limitation independently on every learning value in a calculation equation which comprises a plurality of learning values of different type, does not necessarily limit the total effect of the learning values within a desirable range.

In other words, when all the learning values approach their upper or lower limit, the total effect of these learning values may have already been out of the desirable range.

This will be described more specifically. Assume that the following limits have been set regarding KLCD2 (learning value of multiplication term) and KLCD3 (learning value of addition term) in the equation (4).

$$90\% \leqq KLCD2 \leqq 110\%$$

$$-0.1 \text{ msec} \leqq KLCD3 < +0.1 \text{ msec}$$

KLCD2 is a multiplication term for the basic injection pulse width Tp, and KLCD3 is an addition term for the basic injection pulse width Tp.

Therefore the upper limit of KLCD2 is 110% and the lower limit of KLCD2 is 90% regardless of the magnitude of Tp. On the other hand, the upper and lower limits of KLCD3 become relatively large as Tp becomes smaller.

FIG. 15A is a diagram which shows each limiting value of the learning values KLCD2 and KLCD3 as percentages relative to the basic injection pulse width Tp. As is clear from this diagram, in the region where Tp is small, the proportion of Tp represented by the limiting value of the learning value KLCD3 remarkably increases. Therefore if the learning value KLCD3 is in the vicinity of the limit of ±0.1 msec when there is a learning value KLCD2 in the vicinity of the upper limit 110% or the lower limit 90%, the proportion occupied by the two learning values may exceed ±10% of Tp.

However, when the proportion of the learning value in Tp increases, the effect on incorrect learning on the air-fuel ratio fluctuation also becomes large. From the viewpoint of stable running of the engine, it is not desirable that the air-fuel ratio fluctuates due to incorrect learning.

SUMMARY OF THE INVENTION

It is therefore an object of this invention to suppress the effect of incorrect learning on an air-fuel ratio control by limiting a total value of a proportion of an addition term and multiplication term to the basic injection pulse width.

In order to achieve the above object, this invention provides an engine air-fuel ratio controller, comprising a fuel injector for injecting fuel for providing an air-fuel mixture to an engine, a sensor for detecting an engine load, a sensor for detecting an engine rotation speed, and a microprocessor.

The microprocessor is programmed to calculate a basic injection amount based on the engine load and the engine rotation speed, pre-store a learning value of a multiplication term for correcting the basic injection amount by multiplying the learning value of the multiplication term and the basic injection amount, pre-store a learning value of an addition term for correcting the basic injection amount by adding the learning value of the addition term to the basic injection amount, convert the learning value of the addition term to a proportion relative to the basic injection amount, modify the learning values so that the sum of the proportion and the learning value of the multiplication term is within a predetermined range, calculate a target fuel injection amount from the basic injection amount and a modified learning values, and control the fuel injector so that an injection amount of the fuel injector coincides with the target injection amount.

This invention also provides an engine air-fuel ratio controller, comprising a fuel injector for injecting fuel for providing an air-fuel mixture to an engine, a sensor for detecting an engine load, a sensor for detecting an engine rotation speed, a sensor for detecting an air-fuel ratio of the air-fuel mixture, and a microprocessor.

The microprocessor is programmed to calculate a basic injection amount based on the engine load and the engine rotation speed, calculate a feedback correction amount of the basic injection amount such that an air-fuel ratio coincides with a predetermined target air-fuel ratio, learn a multiplication term for correcting the basic injection amount by multiplying the multiplication term and the basic injection amount, based on the feedback correction amount, learn an addition term for correcting the basic injection amount by adding the addition term to the basic injection amount, based on the feedback correction amount, convert a learned addition term to a proportion relative to the basic injection amount, modify a learned multiplication term and a learned addition term such that the sum of the proportion and the learned multiplication term, is within a preset first range (RLRMAX#, RLRMIN#), calculate a target injection amount based on the basic injection amount, a modified multiplication term and a modified addition term, and control the fuel injector so that an injection amount of the fuel injector coincides with the target injection amount.

It is preferable that the microprocessor is programmed to modify the learned addition term such that the learned addition term lies within a second range (LTSMAX2, LTSMIN2), and modify the multiplication term based on a modified addition term.

It is further preferable that the microprocessor is programmed to calculate the proportion based on the modified addition term, and to modify the multiplication term such that the sum of the proportion and the multiplication term lies within the first range (RLRMAX#, RLRMIN#).

It is also preferable that the second range (LTSMAX2, LTSMIN2) is specified as a fuel injection amount.

It is also preferable that the microprocessor is programmed to modify the learned addition term such that the learned addition term lies within the narrower of the second range (LTSMAX2, LTSMIN2) and a range (LTSMAX#, LTSMIN#) specified by predetermined fixed values, and modify the multiplication term based on a modified addition term.

It is also preferable that the microprocessor is programmed to modify the learned addition term such that the learned addition term lies within the second range (LTSMAX2, LTSMIN2), convert a modified addition term to the proportion, and modify the multiplication term such that the sum of the proportion and the multiplication term lies within the first range (RLRMAX#, RLRMIN#).

It is also preferable that the microprocessor is further programmed to learn the addition term but not learn the multiplication term under a predetermined engine running condition.

In this case, the predetermined engine running condition is, for example, that the engine load is equal to or less than a predetermined value and the engine rotation speed is equal to or less than a predetermined value.

It is also preferable that the microprocessor is further programmed to learn the multiplication term for each of plural running regions determined according to the engine load and the engine rotation speed.

In this case, it is further preferable that the microprocessor is programmed to modify the learned addition term such that the learned addition term lies within a second range (LTSMAX2, LTSMIN2), determine the proportion based on a value obtained by dividing a modified addition term by a minimum value of the basic injection amount in a running region, and modify the multiplication term such that the sum of the proportion and the multiplication term lies within the first range (RLRMAX#, RLRMIN#).

It is also preferable that the microprocessor is programmed to modify the learned addition term such that the learned addition term lies within a second range (LTSMAX2, LTSMIN2), determine the proportion based on a value obtained by dividing a modified addition term by a minimum value of the basic injection amount in a running region, and modify the multiplication term such that the sum of the proportion and the multiplication term lies within the first range (RLRMAX#, RLRMIN#), and such that the multiplication term lies within the first range (RLRMAX#, RLRMIN#).

It is also preferable that the microprocessor is programmed to modify the learned multiplication term and the learned addition term at a timing when the microprocessor learns the multiplication term and the addition term.

It is also preferable that the microprocessor is programmed to modify the learned multiplication term and the learned addition term at a timing when the microprocessor calculates the target fuel injection amount.

In this case, it is further preferable that the microprocessor is further programmed to relearn modified values when the microprocessor modifies the learned multiplication term and the learned addition term.

It is also preferable that the microprocessor is further programmed to modify the learned addition term such that the learned addition term lies within a second range (LTSMAX2, LTSMIN2), modify the multiplication term based on a modified addition term, and modify the second range (LTSMAX2, LTSMIN2) based on a modified multiplication term when the engine load is equal to or less than a predetermined value, and the engine rotation speed is equal to or greater than a predetermined value.

This invention also provides an engine air-fuel ratio controller for use with an engine provided with a canister for adsorbing fuel vapor in a fuel tank and a fuel vapor processor for supplying adsorbed fuel in the canister to the engine.

The controller comprises a fuel injector for injecting fuel for providing an air-fuel mixture to an engine, a sensor for detecting an engine load, a sensor for detecting an engine rotation speed, a sensor for detecting an air-fuel ratio of the air-fuel mixture, and a microprocessor.

The microprocessor is programmed to calculate a basic injection amount based on the engine load and the engine rotation speed, calculate a feedback correction amount of the basic injection amount such that the air-fuel ratio coincides with a predetermined target air-fuel ratio, determine whether or not fuel supply from the fuel vapor processor to the engine has stopped, learn a multiplication term for correcting the basic injection amount by multiplying the multiplication term and the basic injection amount, based on the feedback correction amount, when fuel supply from the fuel vapor processor to the engine has stopped, learn an addition term for correcting the basic injection amount by adding the addition term to the basic injection amount, based on the feedback correction amount, convert a learned addition term to a proportion relative to the basic injection amount, modify a learned multiplication term and a learned addition term such that the sum of the proportion and the learned multiplication term, is within a preset first range (RLRMAX#, RLRMIN#), calculate a target injection amount based on the basic injection amount, a modified multiplication term and a modified addition term, and control the fuel injector so that an injection amount of the fuel injector coincides with the target injection amount.

It is preferable that the microprocessor is programmed to learn the multiplication term for each of plural running regions determined according to the engine load and the engine rotation speed, modify the learned addition term such that the learned addition term lies within a second range (LTSMAX2, LTSMIN2), determine the proportion based on a value obtained by dividing the modified addition term by a minimum value of the basic injection amount in a running region, and modify the multiplication term such that the sum of the proportion and the multiplication term lies within the first range (RLRMAX#, RLRMIN#).

It is also preferable that the microprocessor is programmed to learn the multiplication term for each of plural running regions determined according to the engine load and the engine rotation speed, modify the learned addition term such that the learned addition term lies within a second range (LTSMAX2, LTSMIN2), determine the proportion based on a value obtained by dividing the modified addition term by a minimum value of the basic injection amount in a running region, and modify the multiplication term such that the sum of the proportion and the multiplication term lies within the first range (RLRMAX#, RLRMIN#), and such that the multiplication term lies within the first range (RLRMAX#, RLRMIN#).

The details as well as other features and advantages of this invention are set forth in the remainder of the specification and are shown in the accompanying drawings.

DESCRIPTION OF THE PREFERRED EMBODIMENTS

Figure 1:
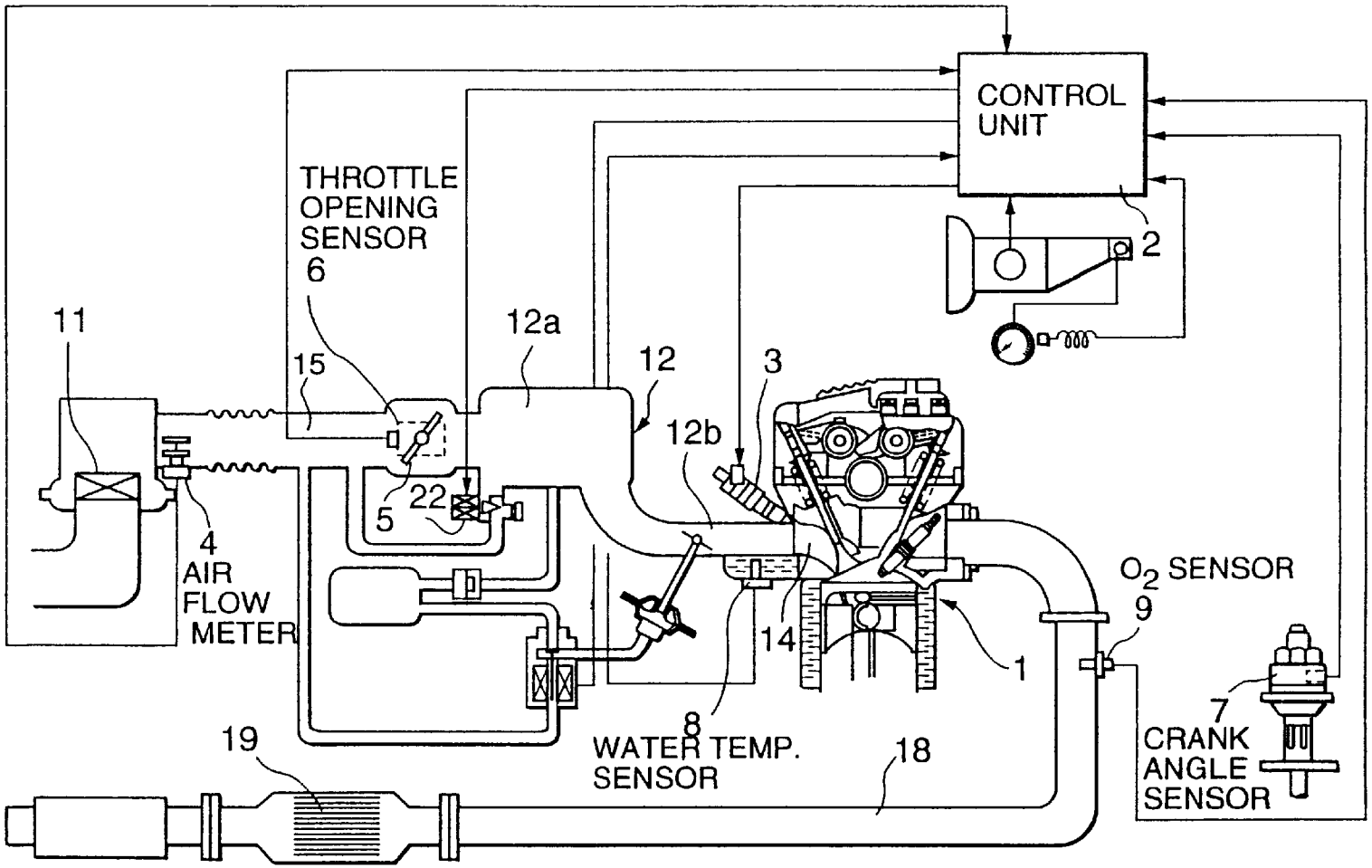
FIG. 1 is a schematic diagram of an air-fuel ratio controller according to this invention.

Referring to FIG. 1 of the drawings, intake air of a vehicle engine 1 passes from an air cleaner 11 through an intake passage 15, intake manifold 12 and intake port 14 to a cylinder of an engine 1. A throttle 5 is provided to adjust an intake amount in the intake passage 15.

Fuel is injected from a fuel injector 3 into the intake air flowing through the intake port 14. Fuel is mixed with intake air so as to form an air-fuel mixture, and the engine 1 is rotated by burning this air-fuel mixture in the cylinder.

Exhaust due to combustion is discharged into the atmosphere through a three-way catalytic converter 19 via an exhaust passage 18.

This engine 1 comprises a fuel vapor processor, not illustrated. In this processor, fuel vapor is temporarily accumulated in a canister, and is supplied as purge gas to an intake passage 3 by using a differential pressure between the intake passage 4 and atmospheric pressure led into the canister. Such a fuel vapor processor is known from U.S. Pat. No. 5,425,349.

The injection amount of the fuel injector 3 is controlled via an injection signal output by the control unit 2 so that the air-fuel ratio of the air-fuel mixture in the cylinder is the stoichiometric air-fuel ratio or a predetermined lean air-fuel ratio according to predetermined engine running conditions.

To perform this air-fuel ratio control, a Ref signal and a Pos signal from a crank angle sensor 7 built into a distributor are input into the control unit 2. In a four cylinder engine, the Ref signal is output every 180°, and in a six cylinder engine it is output every 120°. The Pos signal is a signal output at every 1 degree of rotation of the engine.

Further input to the control unit 2 are an intake air amount signal from an air flow meter 4, an air-fuel ratio signal from an O2 sensor 9 installed upstream of a three-way catalytic converter 19, an engine cooling water temperature signal from a water temperature sensor 8, and a throttle opening signal from a throttle sensor 6. The O2 sensor 9 is a sensor which detects whether the air-fuel ratio of the air-fuel mixture supplied to the cylinder is rich or lean relative to the stoichiometric air-fuel ratio from the oxygen concentration of the exhaust.

Based on the input signals from these sensors, the control unit 2 calculates a basic injection pulse width Tp from the intake air flowrate and rotation speed of the engine 1. Feedback control of the air-fuel ratio is then performed so that the air-fuel ratio of the air-fuel mixture supplied to the cylinder fluctuates mainly around the stoichiometric air-fuel ratio with a predetermined period. This control applies to a sequential mode synchronous injection wherein injection is performed in sequence in every cylinder in synchronism with the Ref signal.

The control unit 2 performs learning control by applying a map learning value TALP, an ineffectual pulse width learning value LRNTS and basic learning value BSALP in order to increase the precision of the air-fuel ratio control.

The map learning value TALP is intended to eliminate deviation from the stoichiometric air-fuel ratio due to errors in the flowrate characteristics of the fuel injector 3 and air flow meter 4 during manufacture and time-dependent deterioration thereof.

The ineffectual pulse width learning value LRNTS compensates for a deviation of the timing of the opening of the fuel injector 3 from the design timing due to manufacturing errors in fuel injector components and time-dependent deterioration thereof.

The basic learning value BSALP is a learning value of the following type. When the map learning value TALP learned in a state in which purge gas is supplied from the canister to the intake passage 3 is applied during purge cut where the purge gas is not supplied, the air-fuel ratio tends toward lean. Under such a condition, therefore, the basic learning value BSALP is used instead of the map learning value TALP.

The details of the air-fuel ratio control performed by the control unit 2 will now be described with reference to the flowcharts.

Figure 2:
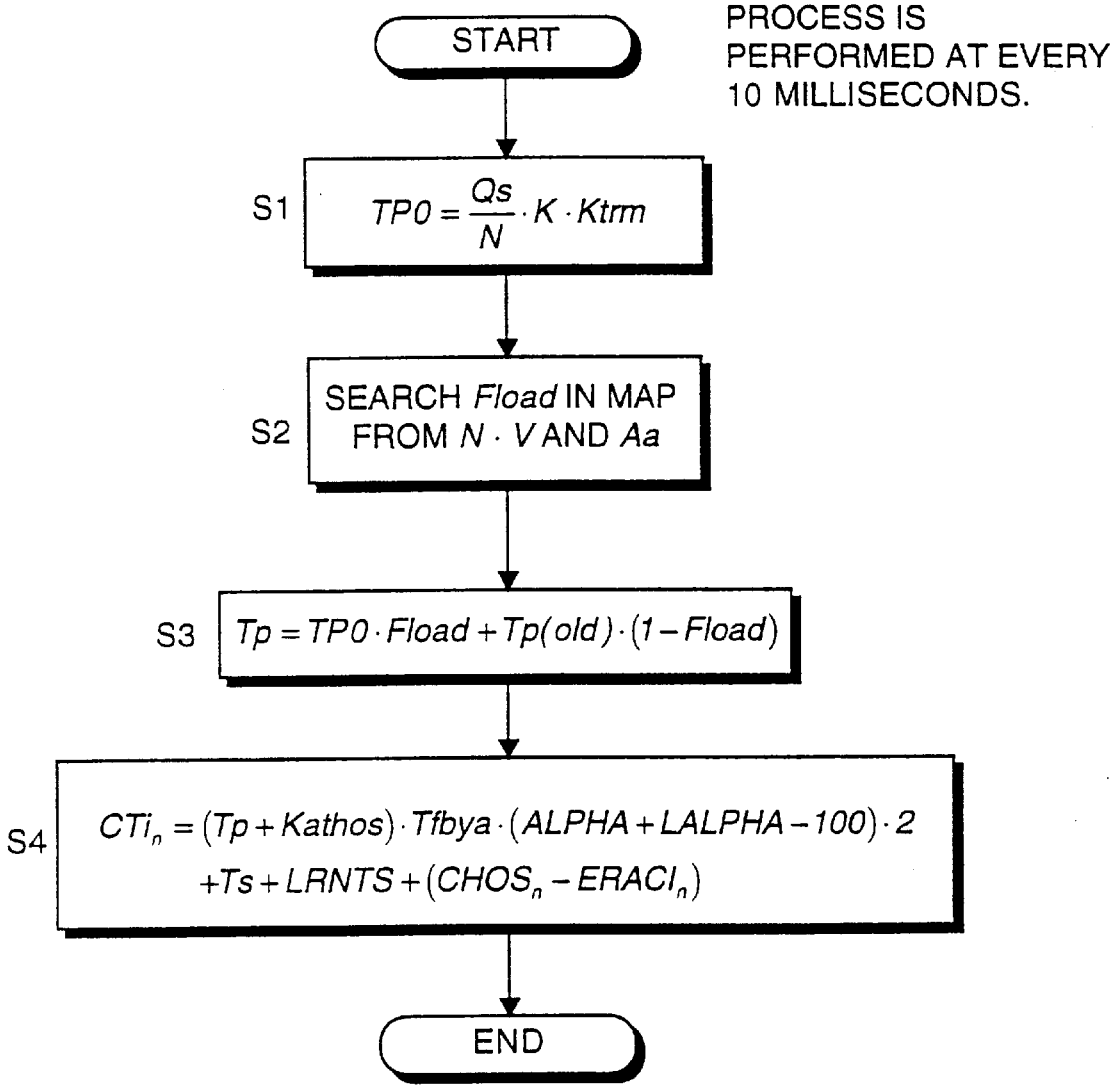
FIG. 2 is a flowchart for describing a calculation process of cylinder-specific fuel injection pulse width $CTi_n$ by the, air-fuel ratio controller.

The flowchart of FIG. 2 shows a process for calculating a cylinder-specific injection pulse width $CTi_n$(msec). This process is executed for example at an interval of 10 msec.

In the following expressions, terms followed by n denote cylinder-specific values.

The cylinder-specific fuel injection pulse width $CTi_n$, a cylinder-specific wall flow correction pulse width $Chos_n$ and a cylinder-specific oversupply correction pulse width $ERACI_n$ are examples of this.

First, in a step S1, a basic injection pulse width TP0 (msec) is found by the next expression (5) from the intake air flowrate Qs (g/sec) obtained from the output of the air flow meter 6, and the engine rotation speed n (rpm) obtained from the crank angle sensor 7.

$$TP0 = \frac{Qs}{N} \cdot K \cdot Ktrm \tag{5}$$

where, K=injection constant determined so as to obtain an air-fuel mixture having the stoichiometric air-fuel ratio, Ktrm=specific trimming coefficient determined by the flowrate characteristics of the fuel injector 4.

In a step S2, a weighted average coefficient Fload (%) is found by referring to a predetermined map from a product n×V of the rotation speed n [rpm] and cylinder volume V

[cc], and a flowpath total cross-sectional area Aa (cm2) of the throttle 5. The flowpath total cross-sectional area Aa is obtained by adding the flowpath cross-sectional area of an idle adjusting-valve 22 or an air regulator, not shown, to the flowpath cross-sectional area of the throttle 5.

In a step S3, the basic injection pulse width Tp (msec) corresponding to the cylinder intake air amount is calculated by the following equation (6) taking account of the distance between the air flow meter 4 and the cylinder.

$$Tp=TP0\cdot\text{Fload}+Tp(\text{old})\cdot(1-\text{Fload}) \quad (6)$$

where, Tp(old)=immediately preceding value of Tp.

In a step S4, the fuel injection pulse width $CTi_n$ is calculated for each cylinder by the following equation (7).

$$CTi_n=(Tp+Kathos)\cdot Tfbya\cdot(ALPHA+LALPHA-100)\cdot 2+Ts+LRNTS+(CHOS_n-ERACI_n) \quad (7)$$

where, Kathos=transient correction amount (msec),

Tfbya=target fuel air ratio equivalent amount (absolute number),

ALPHA=air-fuel ratio feedback correction coefficient (%),

LALPHA=correction coefficient learning value (%),

Ts=Ineffectual pulse width (msec),

LRNTS=Ineffectual pulse width learning value (msec), $Chos_n$=Cylinder-specific wall flow correction pulse width (msec), $ERACI_n$=cylinder-specific oversupply correction pulse width (msec).

The target fuel air ratio equivalent amount Tfbya is the sum of a water temperature increase correction coefficient Ktw, post-startup increase correction coefficient Kas and target fuel air ratio Dml. Under conditions wherein air-fuel ratio feedback control is performed, Ktw=0, Kas=0, Dml=1.0 (in other words, Tfbya=1.0).

On a cold start-up when the engine rotation is unstable, Ktw and Kas take values greater than 0 (i.e. Tfbya has a value greater than 1.0), and the fuel amount is increased. When lean running conditions occur after warmup is complete, Dml has a value of less than one, fuel is reduced, and the engine is run on a lean air-fuel ratio. The calculation of the target fuel air ratio equivalent amount Tfbya is known from German Patent No. 2277609, for example.

Deviation of the target value of air-fuel ratio when the engine is accelerating or decelerating, i.e. during transient running conditions, is due to a quantitative variation of "wall flow", wherein fuel adheres to the intake manifold or intake port as a liquid and flows over the wall surfaces into the cylinder. In equation (7), a fuel correction is performed to correct for oversupply or undersupply due to this wall flow.

Wall flow may be a relatively slow response wall flow wherein only a small proportion of fuel flows directly into the cylinder, and a relatively fast response wall flow, wherein a high proportion of fuel flows directly into the cylinder. In equation (7), Kathos is used to correct for the former type of wall flow, and $Chos_n$ and $ERACI_n$ are used to correct for the latter type of wall flow. These wall flow corrections are known from Tokkai Hei 1-305144 published by the Japanese Patent Office in 1989.

In the aforesaid prior art, the ineffectual pulse width Ts was a term used to correct for the response delay of the fuel injector, as described above.

The 2 before Ts on the right-hand side of the equation (7) is a value corresponding to sequential injection, wherein one injection is performed for every two rotations of the engine in every cylinder.

Tp(old) in the equation (6) and ALPHA(old), described hereafter, are initialized to 0 on engine start-up.

In a correction coefficient learning value LALPHA of the equation (7), a map learning value TALP and basic learning value BSALP are applied selectively according to whether the purge fuel is supplied from the canister to the intake passage 15 during lean running conditions.

Figure 4:
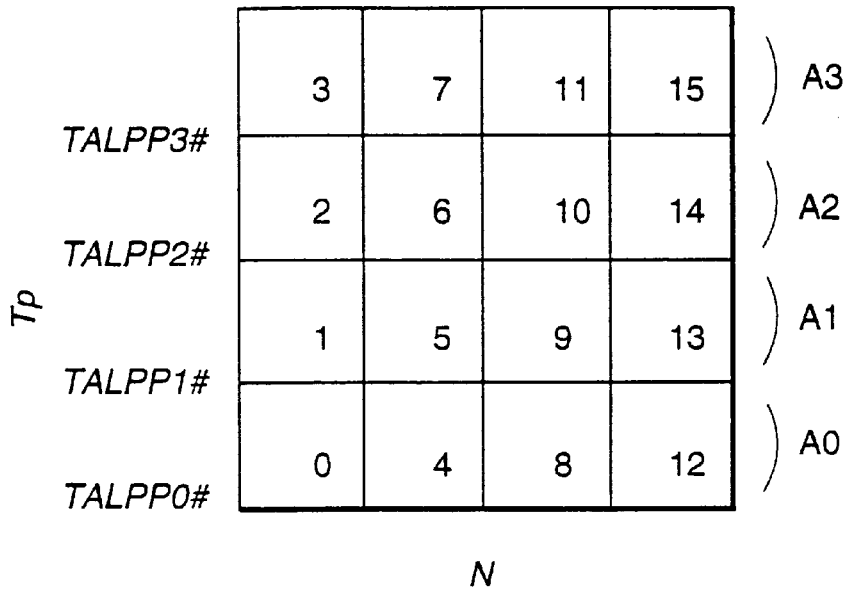
FIG. 4 is a diagram showing the contents of a map of a map learning value TALP stored by the air-fuel ratio controller.

As shown in FIG. 4, the learning region of a map learning value TALP is specified by a map wherein the basic injection pulse width Tp is divided into four regions, i.e. predetermined values TALPP0# (=0), TALPP1#, TALPP2#, TALPP3#, and the engine rotation speed n is also divided into four regions. On this map, a total of 16 learning regions are set by combinations of Tp and n regions. Learning values are stored independently for each of these learning regions.

The control unit 2 stores this map, and searches or updates learning values of corresponding regions by looking up a map based on the basic injection pulse width Tp and engine rotation speed n. According to this embodiment, learning regions are differentiated by assigning a number to them from 0 to 15. In the following description, the learning region 0 for example refers to a region indicated by 0 on the TALP map of FIG. 4.

The basic learning value BSALP is learned during purge cut. In the case of the basic learning value BSALP, regardless of the learning region of the map learning value TALP, a region such that the whole area during lean running conditions can be represented, is taken as the learning region. Learning values are updated in this single region, but are looked up over the whole range of driving conditions.

Memories for storing map learning values and basic learning values, as well as those for storing ineffectual pulse width learning values, are backup RAMs which preserve the stored contents even after the engine has stopped running.

The air-fuel ratio is feedback controlled only when the target air-fuel ratio is equal to the stoichiometric air-fuel ratio.

As the O2 sensor 9 has only a function to detect whether the air-fuel ratio is rich or lean relative to the stoichiometric air-fuel ratio, the air-fuel ratio cannot be feedback-controlled under conditions when the target air-fuel ratio is set to be lean.

Even when running on a lean air-fuel ratio, the equation (7) is applied to the calculation of the fuel injection amount. However, under lean running conditions, the air-fuel ratio feedback correction coefficient ALPHA is set to 1.0 in the equation (7), and the target fuel air ratio equivalent amount Tfbya is set to a predetermined lean air-fuel ratio equivalent amount. Learning values and transient corrections are applied as in the case of the stoichiometric air-fuel ratio, but under lean running conditions, updating of learning values is not performed.

Next, referring to the flowchart of FIG. 3, the application of the map learning value TALP and basic learning value BSALP to the above-mentioned correction coefficient learning value LALPHA, will be described. This process is performed at a fixed interval or as a background job.

The correction coefficient learning value LALPHA and air-fuel ratio feedback correction coefficient ALPHA are expressed as percentages centered on 100%.

First, in a step S11, it is determined whether or not the running conditions of the engine 1 represented by the basic injection pulse width Tp and engine rotation speed n, are in a region 0 shown in FIG. 4.

When the running conditions are in the region 0, in a step S12, 100 is inserted in LALPHA (%) so as to perform learning of the ineffectual pulse width Ts.

When the running conditions are in any region except the region 0, the routine proceeds to a step S13, and it is determined whether or not the cooling water temperature Tw is equal to or greater than a predetermined value TWLCL#.

When the cooling water temperature Tw is equal to or greater than the predetermined value TWLCL#, in a step S14, it is determined whether or not a flag FLEAN is equal to 1. Herein, the flag FLEAN is a flag which is set to "1" when lean running conditions are satisfied.

When lean running conditions hold, it is determined in a step S15 whether or not a map learning convergence counter CLRNTDi ($0 \leqq i \leqq 15$) is equal to or greater than a predetermined number NLRNTD# which has been set for determining convergence of map learning values.

The map learning convergence counter CLRNTDi is a counter stored by the backup RAM, and i shows the number of the learning region. Each time the map learning value TALP is updated in each learning region, the map learning convergence counter CLRNTDi accumulates the number of updates for each learning region.

When $Tw \geqq TWLCL\#$, FLEAN=1, $CLRNTDi \geqq NLRNTD\#$, the routine proceeds to a step S16, the TALP map of FIG. 4 is looked up to find the map learning value TALP (%), and this is entered in a variable LRNALP (%).

In the case of map learning values, as a plurality of learning values exist for each region, the variable LRNALP, in which the TALP selected according to the engine running conditions is entered, is used for the calculation of the fuel injection amount.

The limit processing of a step S17 is specific to this invention, and it will be described together with the processing of other similar steps S21, S25 and S28 later.

In a step S18, a difference between a basic learning value BSALP (%) and a threshold value SLALP (%) is calculated, and this difference is compared with the variable LRNALP corresponding to the map learning value.

When $BSALP-SLALP \leqq LRNALP$, in a step S19, the value of LRNALP is used as the correction coefficient learning value LALPHA so as to select a map learning value as LALPHA.

On the other hand, when $BSALP-SLALP \geqq LRNALP$, the basic learning value BSALP is applied to the correction coefficient learning value LALPHA.

After performing limit processing described hereafter on the basic learning value BSALP in a step S21, the value of the parameter BSALP is entered in the correction coefficient learning value LALPHA in a step S22.

Herein, the reason why the basic learning value and map learning value are selectively used as the correction coefficient learning value LALPHA is as follows.

Figure 6:
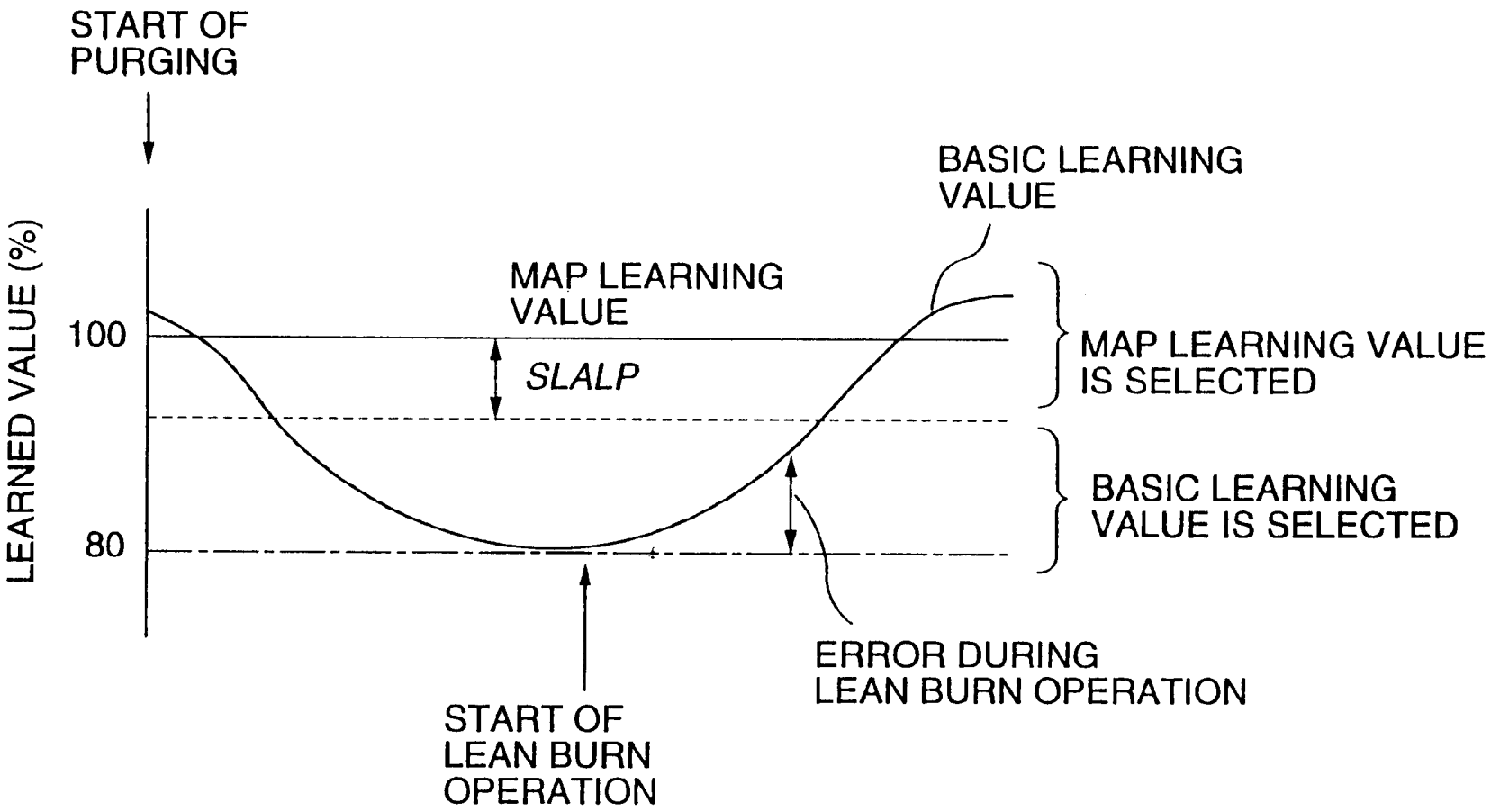
FIG. 6 is a diagram for describing a change-over control of a map learning value and basic learning value according to the air-fuel ratio controller.

When purging of fuel vapor is performed during air-fuel ratio learning control, the map learning value changes as shown in FIG. 6.

On the other hand, the basic learning value is a value learned in purge cut, so after it has converged it remains effectively constant.

When purging of fuel is performed when a large amount of fuel vapor has accumulated in the canister, the air-fuel ratio of the air-fuel mixture in the cylinder temporarily becomes rich. When this rich air-fuel ratio starts to return to the stoichiometric air-fuel ratio, the feedback correction coefficient ALPHA shifts to a value lower than 100%. As a result, the map learning value TALP which is updated based on the variation of ALPHA also falls to less than the threshold value SLALP.

The minimum value of the map learning value TALP in this case is, for example, 80%. Subsequently, the map learning value TALP becomes large again together with decrease of purge gas concentration, and converges to the learning value for the state after purge has continued for some time.

On the other hand, if lean running conditions hold when the map learning value TALP becomes a minimum, the fuel vapor in the canister is eliminated due to continuation of purging of fuel vapor, but the map learning value TALP is not updated further than its value at the peak position, and it retains its value at the peak position as shown by the dot and dash line in the drawing.

This is due to the following reason.

First, learning of the map learning value TALP is not performed so that the feedback coefficient of the air-fuel ratio is fixed at 100% during lean running, and the map learning value TALP under the same conditions is therefore identical.

However, the basic injection amount Tp and engine rotation speed n which are parameters of the map learning value, do not vary immediately even if lean running begins.

Consequently, provided that the running region determined by the basic injection amount Tp and the engine rotation speed n does not change, the map learning value TALP during lean running remains at its value immediately prior to starting lean running.

If the map learning value TALP remains at its minimum value although the fuel supply amount decreases due to continued purging of fuel vapor, the air-fuel ratio during lean running will be largely biased toward lean, and the control precision of the air-fuel ratio will decline.

Hence, when the difference between the basic learning value BSALP and map learning value TALP which is stored as the variable LRNALP is greater than the threshold value SLALP, the basic learning value is used without using the map learning value as a correction coefficient learning value.

When the cooling water temperature Tw is lower than the predetermined temperature TWLCL# in the step S13, or when the map learning convergence counter CLRNTDi has not reached the map learning convergence frequency NLRNTD#, it may be assumed that map learning is not yet sufficient.

In this case also, the routine proceeds from the step S21 to the step S21, and the basic learning value is selected.

On the other hand, when FLEAN=/1 in the step S14, i.e. when lean running conditions do not hold, the routine proceeds from the step S14 to the step S23, and it is determined whether or not a flag FBSLTD is 1. This flag is a flag showing whether the basic learning value BSALP has converged, and the flag FBSLTD is set in a process for updating the basic learning value, described hereafter.

FBSLTD=0 shows that the basic learning value has not yet converged, and FBSLTD=1 shows that the basic learning value has con verged.

When it has not converged, the routine proceeds to a step S26 via limit processing of the step S25 for advancing learning of the basic learning value.

In the step S26, the basic learning value BSALP is set as the correction coefficient learning value LALPHA.

When the basic learning value has converged in the step S23, the map learning value TALP is looked up from a map shown in FIG. 4 in the step S27 in order to advance learning of the map learning value, and is stored in THE variable LRNALP exclusively for the map learning value.

The routine then proceeds to a step S29 via the limit processing of the step S28, and the stored value of the variable LRNALP is set as the parameter ALPHA.

Next, referring to FIG. 7, the process of calculating the air-fuel ratio feedback correction coefficient ALPHA performed by the control unit 2 will be described.

This process is performed in synchronism-with the Ref signal.

The reason for performing this in synchronism with the Ref signal is that fuel injection is performed in synchronism with the Ref signal and naturally, control disturbances occur in synchronism with the Ref signal, hence it is desirable that this correction is also synchronized with the Ref signal.

In a step S31, it is determined whether or not air-fuel ratio feedback control conditions hold.

The feedback control conditions are for example as follows.

(1) The cooling water temperature Tw exceeds the air-fuel ratio feedback control starting water temperature, TWCLMP.

(2) The target air-fuel ratio equivalent amount Tfbya=1.

(3) The inversion frequency of the output signal of the O2 sensor 9 has reached a predetermined value. The predetermined may for example be 1.

A flag FLGCL is provided for this determination, and when FLGCL=1, the inversion frequency is determined to have reached the predetermined value.

When any of the three conditions mentioned above does not hold, it is determined that air-fuel ratio feedback control conditions do not hold.

In this case, the routine proceeds to a step S32, the air-fuel ratio feedback correction coefficient ALPHA is transferred to ALPHA(old) for the immediately preceding occasion, 100% is entered in the air-fuel ratio feedback control coefficient ALPHA and the process is terminated.

When all of the above three conditions hold, it is determined that air-fuel ratio feedback control conditions hold, and the routine proceeds to a step S33.

In the step S33, the output voltage $VO_2$ of the O2 sensor 9 is A/D converted, and in a step S34, $VO_2$ is compared with a slice level SL which is for example set in the vicinity of 500 mV.

When $VO_2$>SL, in a step S35, "1" is entered in an air-fuel ratio flag AF1. When $VO_2$<SL, in a step S36, "0" is entered in the air-fuel ratio flag AF1. Hence, AF1=0 indicates lean, and AF1=1 indicates rich.

Figure 3:
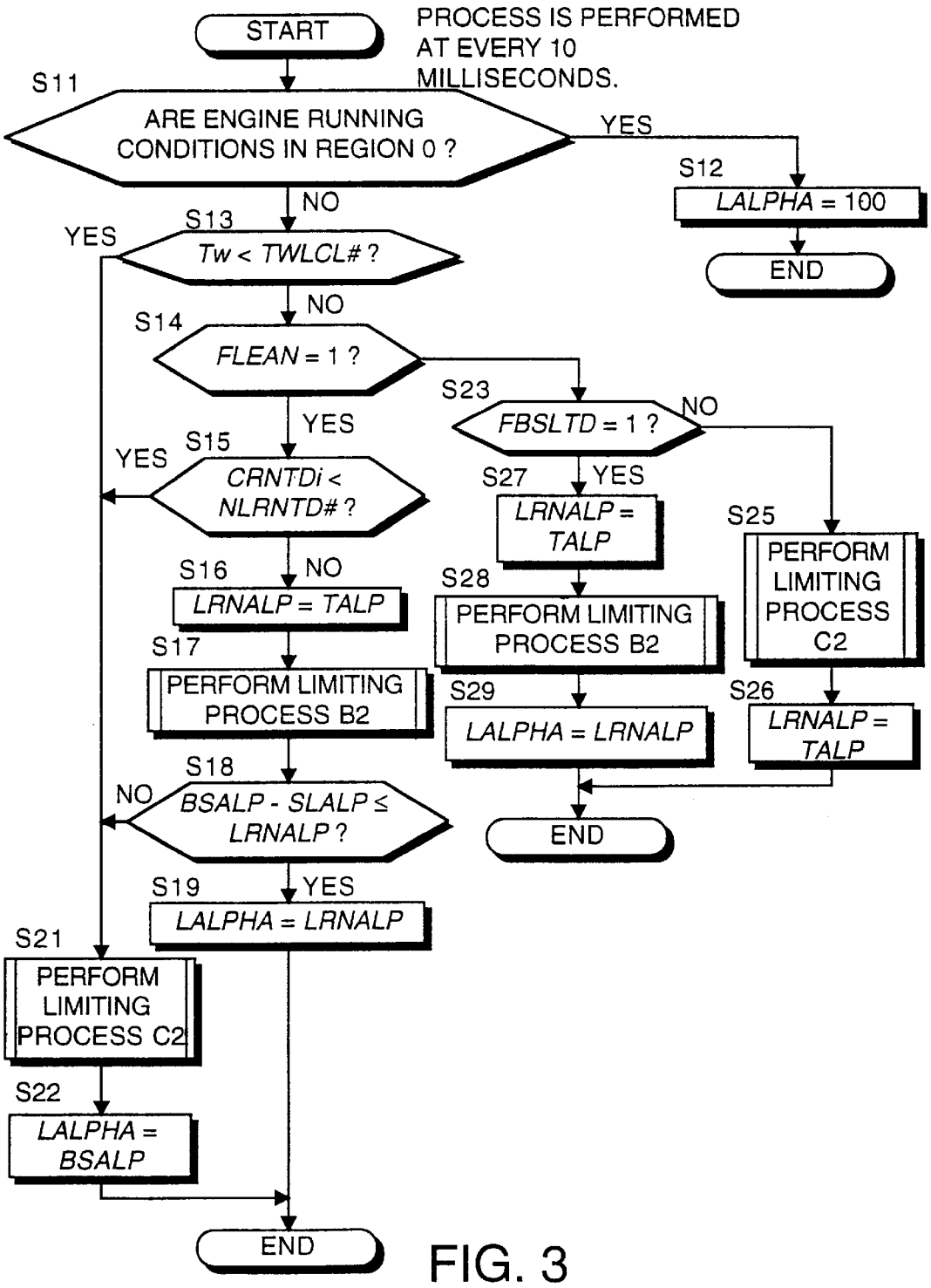
FIG. 3 is a flowchart for describing a search process of a correction coefficient learning value LALPHA by the air-fuel ratio controller.
Figure 7:
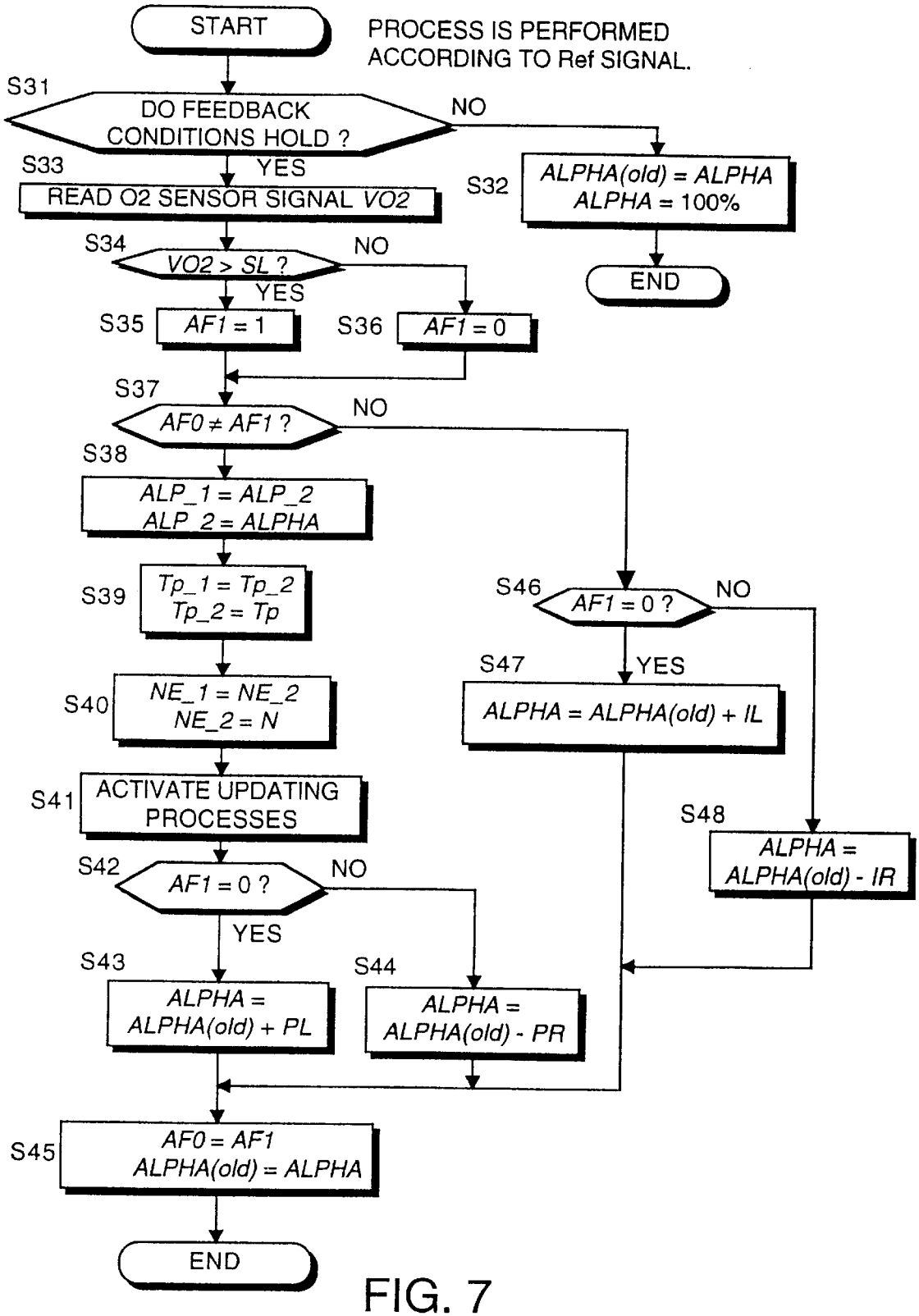
FIG. 7 is a flowchart for describing a process for calculating an air-fuel ratio feedback correction coefficient ALPHA according to the air-fuel ratio controller
Figure 8:
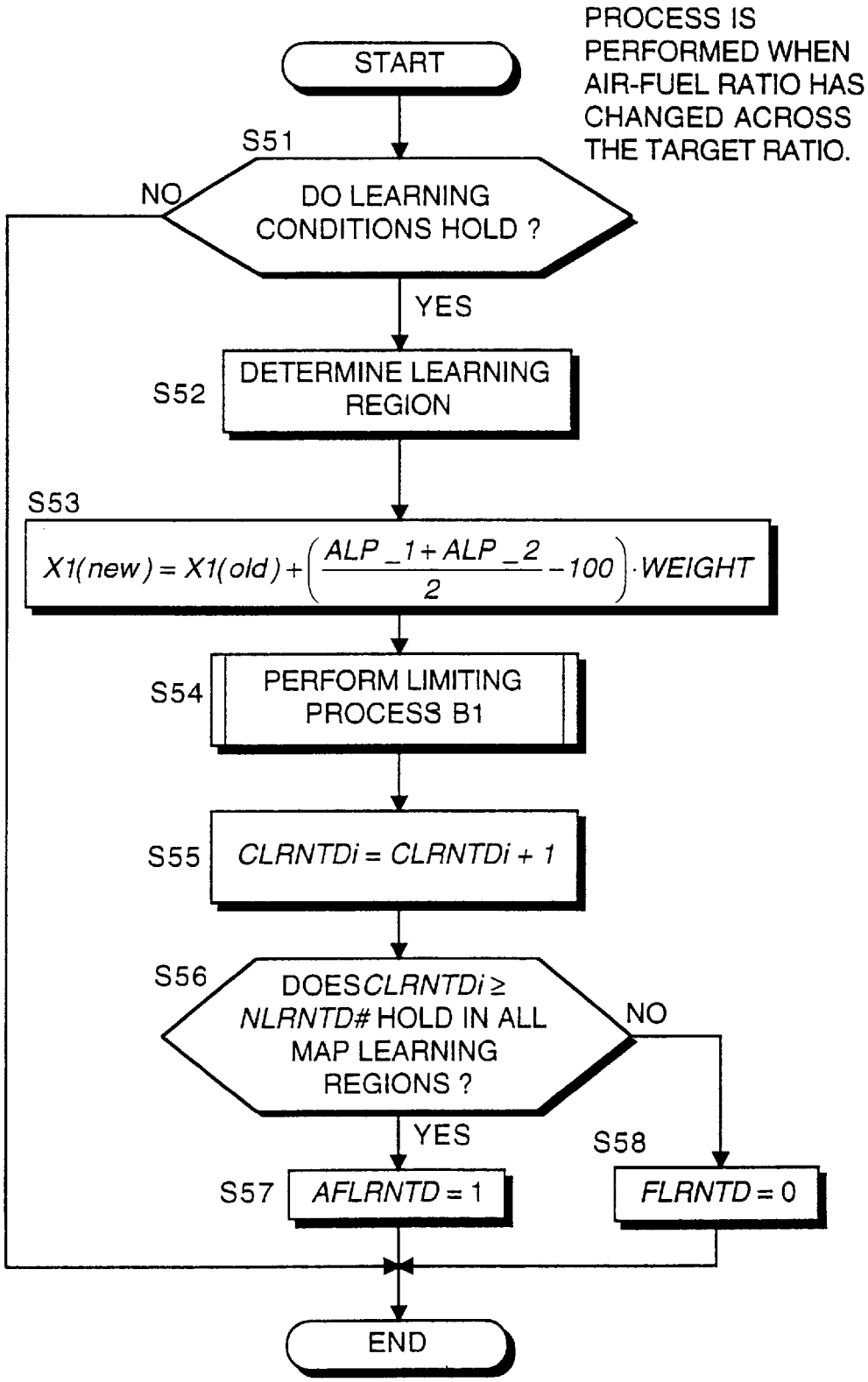
FIG. 8 is a flowchart for describing a process of updating a map learning value performed by the air-fuel ratio controller.
Figure 9:
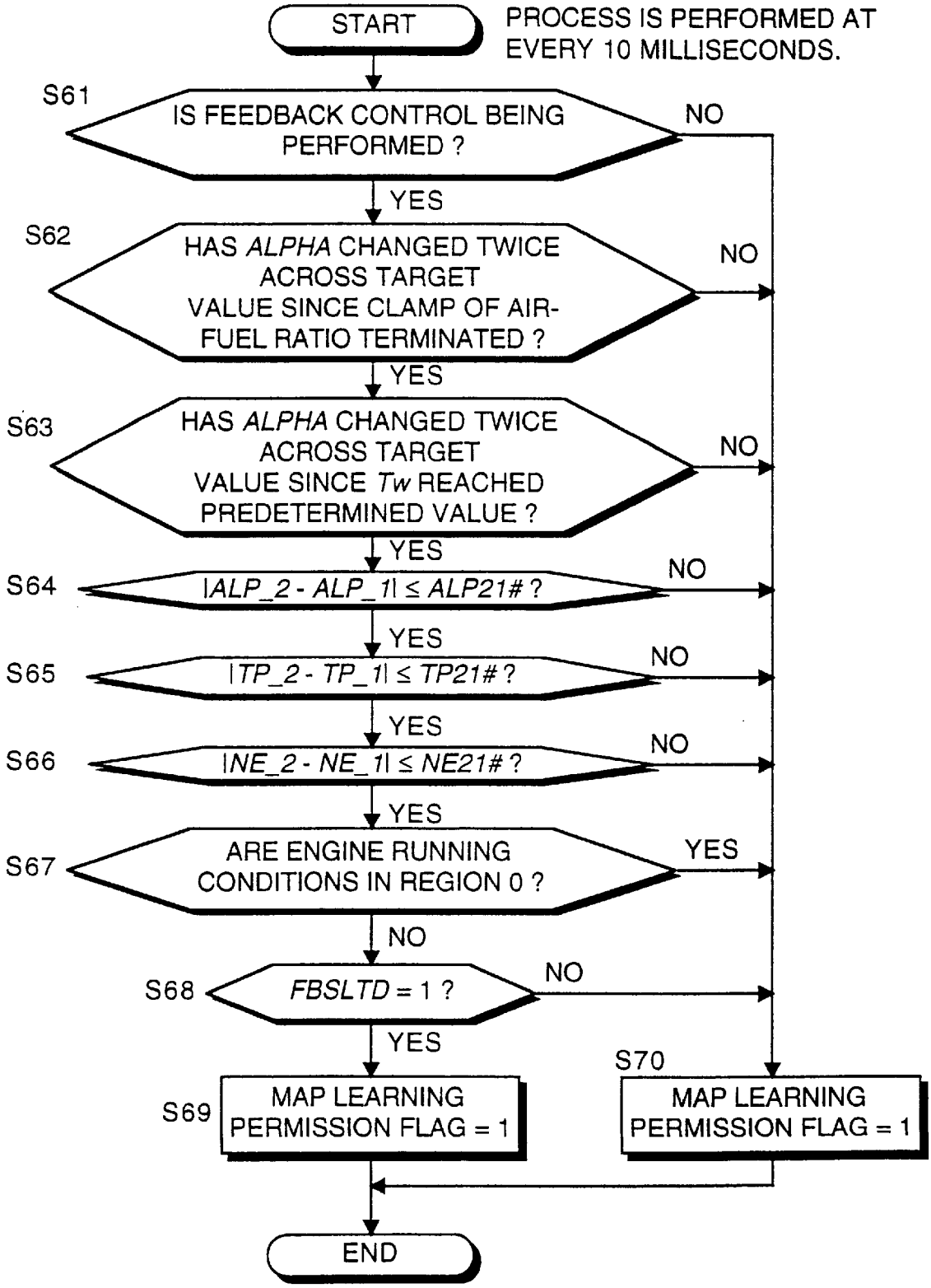
FIG. 9 is a flowchart for describing a determining process of a learning permission condition for the map learning value according to the air-fuel ratio controller.
Figure 10:
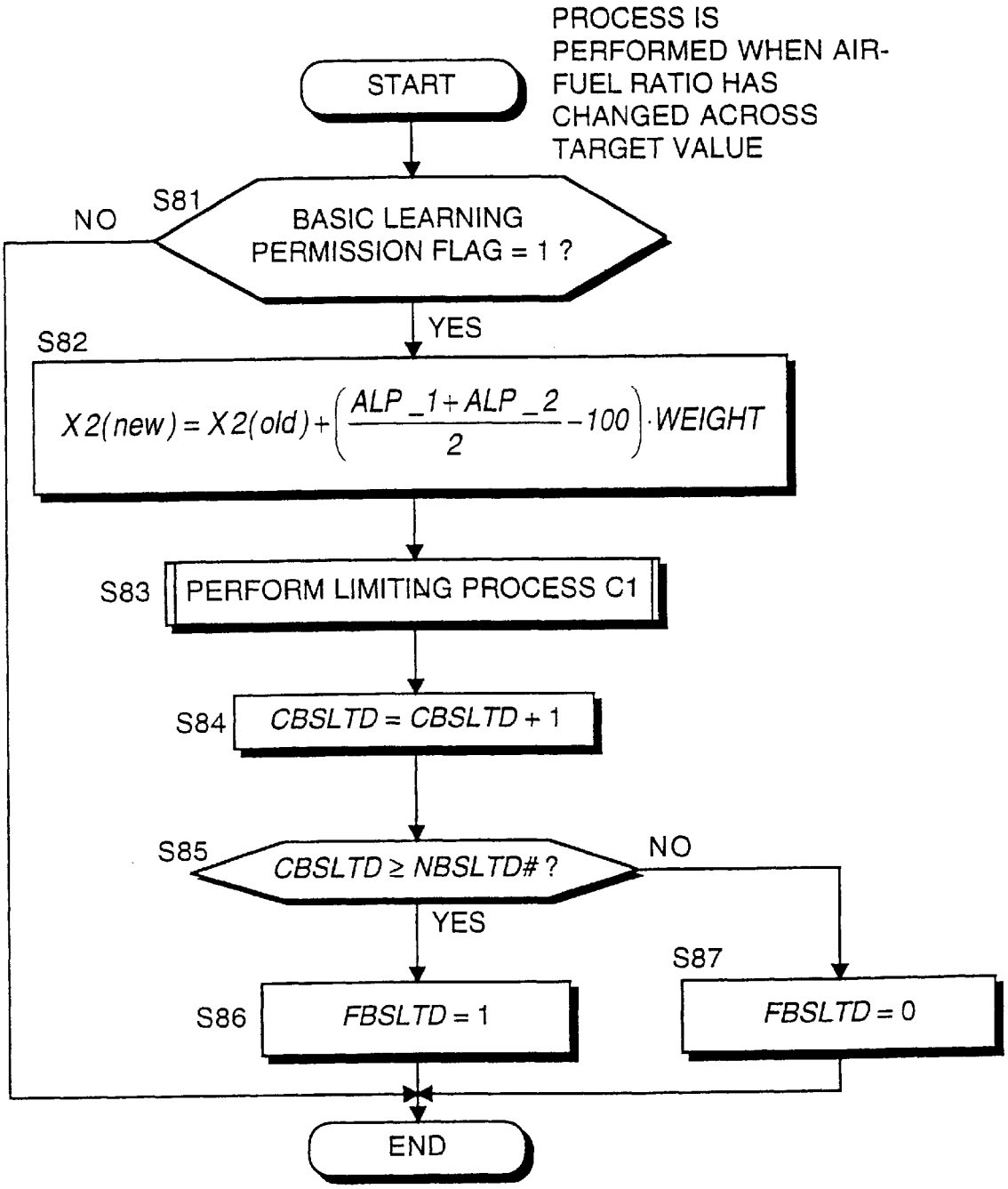
FIG. 10 is a flowchart for describing a process of updating a basic learning value performed by the air-fuel ratio controller.
Figure 11:
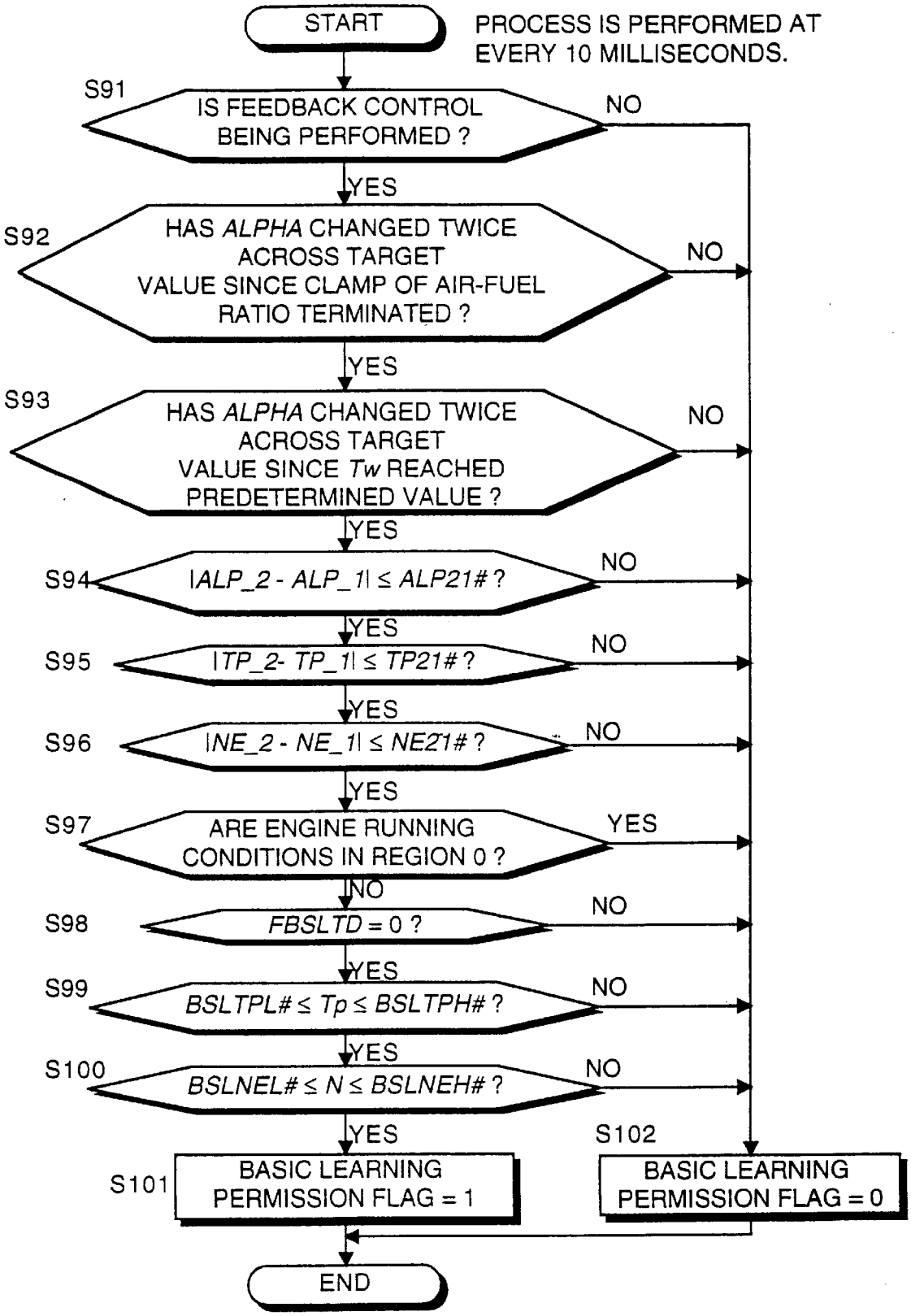
FIG. 11 is a flowchart for describing a process for determining a learning permission condition for the basic learning value according to the air-fuel ratio controller.
Figure 13:
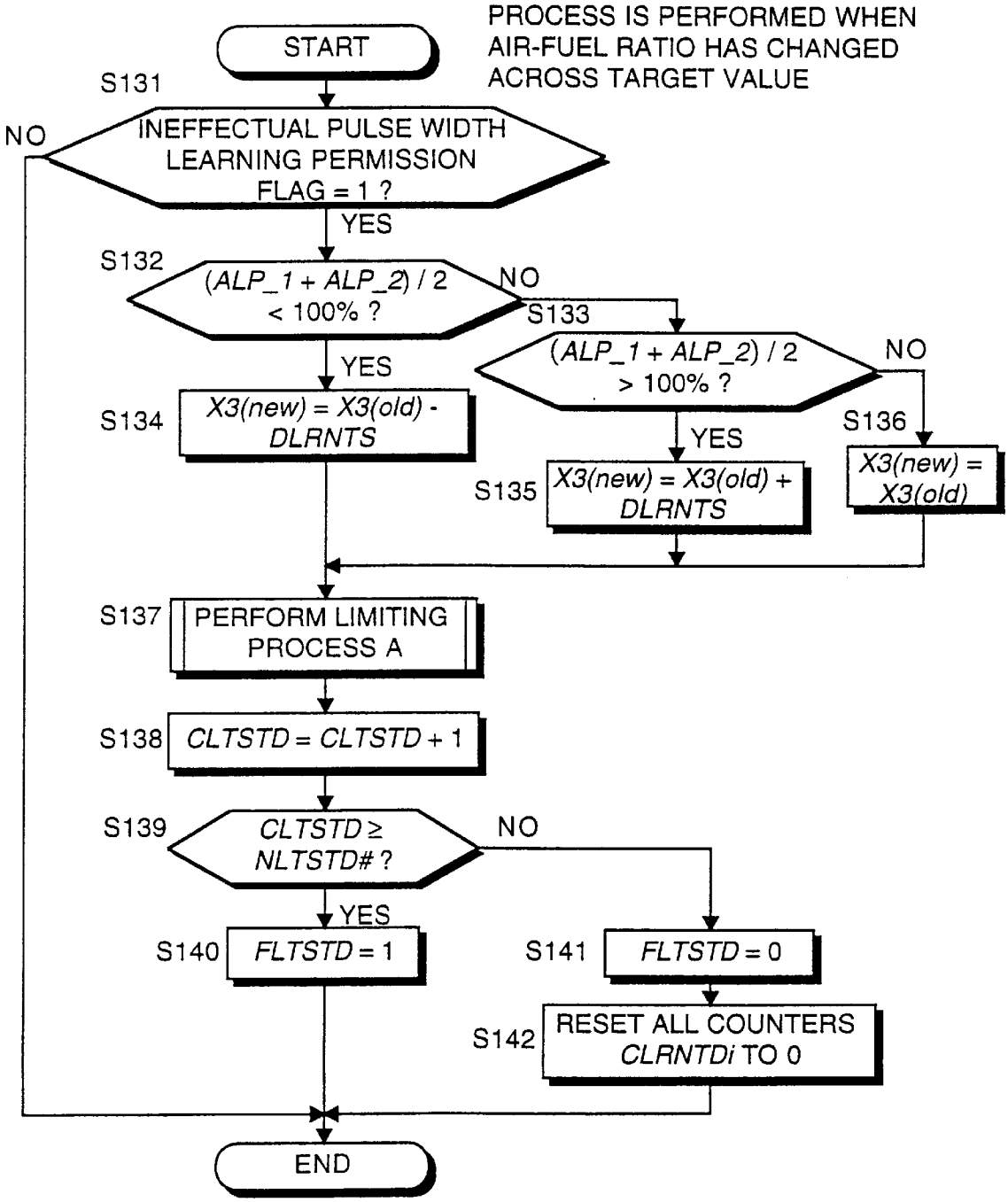
FIG. 13 is a flowchart for describing a process for updating an ineffectual pulse width learning value according to the air-fuel ratio controller.

The air-fuel ratio flag AF1 is initialized when power is switched on together with FLEAN of the step S14 of FIG. 3, FBSLTD of the step S23, AF0 of the step S37 of FIG. 7, FLRNTD of steps S57 and S58 of FIG. 8, FBSLTD of steps S68, S86, S87 and S98 of FIGS. 9–11, and FLTSTD of steps S140 and S141 of FIG. 13.

Variables, i.e. ALP_1 and ALP_2 of a step S38 of FIG. 7, Tp_1 and Tp_2 of a step S39, NE_1 and NE_2 of a step S40, X1(new) and X1(old) of a step S53 of FIG. 8, X2(new) and X2(old) of a step S82 of FIG. 10, and X3(new) and X3(old) of steps S134–S136 of FIG. 13, are also initialized to "0" when power is switched on. In the description herebelow, the initialization of these flags and variables are not specifically mentioned.

In a step S37, AF1 is compared with the air-fuel ratio flag AF0. Herein, AF0 is a flag showing whether the O2 sensor output $VO_2$ was rich or lean on the immediately preceding occasion. AF0=0 signifies lean conditions on the immediately preceding occasion, and AF0=1 signifies rich conditions on the immediately preceding occasion.

Accordingly, when the values of AF0, AF1 are not the same, it means that the air-fuel ratio has inverted from rich to lean or from lean to rich.

When the air-fuel ratio is determined, the routine proceeds to the step S38, the value of the memory ALP_2 (%) is shifted to the memory ALP_1(%) and the value of ALPHA is entered in the memory ALP_2 (%).

This is because the present value of ALPHA during inversion is stored in the memory ALP_2, and the immediately preceding value of ALPHA during inversion is stored in the memory ALP_1.

Likewise, in a step S39, the value of the memory Tp_2 (msec) is shifted to the memory Tp_1 (msec), and the value of the basic injection pulse width Tp calculated in the step S3 of FIG. 2 is entered in the memory Tp_2 (msec). In this way, the present values of Tp and n during air-fuel ratio inversion are stored in the memory Tp_2, NE_2, and the values of Tp and n on the immediately preceding occasion are stored in the memory Tp_1.

In a step S41, updating of the map learning value TALP, basic learning value BSALP and ineffectual pulse width learning value LRNTS, is ordered.

This initiates the processes of FIG. 8, FIG. 10 and FIG. 13, described hereafter.

In a step S42, the value of the air-fuel ratio flag AF1 is determined.

When AF1=0, i.e. when it is immediately after the air-fuel ratio has inverted from rich to lean, in a step S43, the air-fuel ratio feedback correction coefficient ALPHA is calculated by the following equation (8).

$$ALPHA=ALPHA(\text{old})+PL$$

$$ALPHA=ALPHA(\text{old})+PL \quad (8)$$

where, ALPHA(old)=immediately preceding value of ALPHA

PL=proportional part when air-fuel ratio is corrected from rich to lean by proportional integral control (PI control).

When the air-fuel ratio flag AF1=1 in the step S42, i.e. when immediately after the air-fuel ratio changes from lean to rich, the air-fuel ratio feedback correction coefficient ALPHA is calculated by the following equation (9) in a step S44.

$$ALPHA=ALPHA(\text{old})-PR \quad (9)$$

where, PR=proportional part when air-fuel ratio is corrected to lean by proportional integral control (PI control).

In a step S45, in order to perform the next calculation, the value of the air-fuel ratio flag AF1 is shifted to the air-fuel ratio flag AF0, the value of ALPHA is shifted to the memory ALPHA(old), and the routine is terminated.

When on the other hand the two air-fuel ratio flags AF0, AF1 are equal in the step S37, it is determined that the air-fuel ratio has not inverted, and the routine proceeds to a step S46.

In the step S46, the value of the air-fuel ratio flag is determined.

When AF1=0, i.e. when the lean air-fuel ratio persists, the routine proceeds to the step S47.

In the step S47, the air-fuel ratio feedback coefficient ALPHA is calculated by adding IL to the immediately preceding value ALPHA(old) of the air-fuel ratio feedback correction coefficient, and the routine proceeds to the aforesaid step S45. IL is an integral part when the air-fuel ratio is corrected to rich by proportional integral control (PI control).

When AF1=1 in the step S46, ie. when a rich air-fuel ratio persists, the routine proceeds to the step S48.

The air-fuel ratio feedback coefficient ALPHA is calculated by deducting IR from the immediately preceding value ALPHA(old) of the air-fuel ratio correction coefficient, and the routine proceeds to the step S45. IR is an integral part when the air-fuel ratio is corrected to rich by proportional integral control (PI control).

The proportional parts PL, PR, and integral parts IL, IR are first looked up from a map stored in the control unit 2 using the basic injection pulse width Tp and engine rotation speed n as parameters.

Next, the process of updating map learning values performed by the control unit 2 will be described with reference to FIGS. 8 and 9.

This process is performed every time the output of the O2 sensor 9 inverts from rich to lean or vice-versa.

First, in a step S51, it is determined whether or not learning permission conditions hold. This determination is based on a learning permission flag set by a process shown in FIG. 9.

In the steps S61–S68 of FIG. 9, it is determined whether or not the following conditions hold.

This determining process is performed at a fixed interval of, for example, 10 msec.

Step S61: Air-fuel ratio feedback control is being performed.

Step S62: ALPHA has inverted two or more times since the air-fuel ratio feedback control coefficient ALPHA is no longer fixed.

Step S63: ALPHA has inverted two or more times since the cooling water temperature Tw has come to lie with-in the predetermined temperature range, i.e. TWLCL#≦Tw≦TWLCH#.

Step S64: |ALP_2−ALP_1|≦predetermined value ALP21#.

Step S65: |Tp_2−Tp_1|≦predetermined value TLP21#.

Step S66: |NE_2−NE_1|≦predetermined value NE21#.

Step S67: Running conditions do not lie in a range 0 shown in FIG. 4.

Step S68: The basic learning value has converged (FBSLTD=1).

When all of the above conditions hold, a learning permission flag for map learning is set to "1" in a step S69, otherwise when any of the above conditions does not hold, the learning permission flag is reset to "0" in a step S70 so that map learning is prohibited.

The reason why updating of map learning is not permitted in the region 0 in the step S67, is in order to learn an ineffectual pulse width in the region 0.

In this case, the map learning value in the region 0 is set to an initial value of 100%.

The reason why updating of the ineffectual pulse width learning value is limited to the region 0 as described hereafter, is because in this region, the component proportion of the ineffectual pulse width Ts is much larger than that of the basic injection pulse width Tp in $CTi_n$. In this case, the error in the air-fuel ratio is mainly due to error in Ts.

The reason for making convergence of the basic learning value a condition in the step S68 is in order to update the map learning value after convergence of the basic learning value.

When the learning permission conditions hold in a step S51 of FIG. 8, the routine proceeds to a step S52.

When the learning permission-conditions do not hold, the routine is terminated without executing the other steps.

In the step S52, it is determined in which learning region the running conditions are situated.

In a step S53, a new map learning value is calculated by the following equation (10) using the map learning value of the determined learning region.

$$X1(new) = X1(old) + \left(\frac{ALP_1 + ALP_2}{2} - 100\right) \cdot WEIGHT \tag{10}$$

where, X1(new)=map learning value after updating (%),

X1(old)=map learning value before updating (%),

WEIGHT=updating ratio.

After performing limit processing on the value calculated in the step S54, a map learning convergence counter CLRNTDi corresponding to a region to which the running conditions belong is incremented in a step S55.

The step S54 is a characteristic feature of this invention, and will therefore be described later in detail.

At this stage, the value of X1(new) is not stored as a map learning value.

In a step S56, the map learning convergence counter CLRNTDi is compared with the predetermined value NLRNTD# for all regions.

When CLRNTDi≧NLRNTD# in all regions, the routine proceeds to a step S57, the map learning convergence flag FLRNTD is reset to "1", and the routine is terminated.

When CLRNTDi<NLRNTD# in any region, the routine proceeds to a step S58, the map learning convergence flag FLRNTD is set to "0", and the routine is terminated.

Next, the process of updating the basic learning value performed by the control unit 2 will be described with reference to the flowchart of FIGS. 10 and 11.

The process of updating the basic learning value is essentially identical to the process of updating the map learning value, therefore the following description will focus on the parts that are different.

As in the case of the process of FIG. 8, this process is performed each time the output of the O2 sensor 9 inverts from rich to lean or vice-versa.

In a step S81, it is determined whether or not the learning permission conditions hold.

This determination is based on a learning permission flag of the basic learning value set by the process shown in FIG. 11.

The process of FIG. 11 is similar to the process of FIG. 9 which was already described, and is performed at an interval of, for example, 10 msec.

Steps S91–S97 are identical to the steps S61–S67.

The difference lies in steps S98–S102. In these steps, two further conditions must be satisfied. These are that the basic learning value must have converged, i.e. FBSLTD=0, and the basic injection pulse width Tp and engine rotation speed n must both lie within the learning region of the basic learning value shown in FIG. 5.

For this purpose, in a step S98, it is determined whether or not the flag FBSLTD=0.

In a step S99, it is determined whether or not BSLTPL#≦Tp≦BSLTPH#.

In a step S100, it is determined whether or not BSLNEL#≦n≦BSLNEH#.

When all of these conditions hold, a flag for permitting learning of a basic learning value is set to "1" in a step S101, otherwise, when any of these conditions does not hold, the flag for permitting learning of the basic learning value is reset to "0" in a step S102.

Unlike the map learning value, the basic learning value is only one piece of data, therefore the process of updating the basic learning value is simpler than that of updating the map learning value as may be understood by comparing FIG. 10 with FIG. 8.

When learning conditions hold in the step S81, the routine proceeds to a step S82, and a new basic learning value is calculated by the following equation (11).

When the learning permission conditions do not hold, the routine is terminated without executing the other steps.

$$X2(new) = X2(old) + \left(\frac{ALP_1 + ALP_2}{2} - 100\right) \cdot WEIGHT \quad (11)$$

where, X2(new)=basic learning value (%) after updating,

X2(old)=basic learning value (%) before updating,

WEIGHT=updating ratio.

In an updating proportion step S83, limit processing, described hereafter, is performed on the calculated values, and in a step S84, 1 is added to a basic learning value convergence counter CBSLTD.

In a step S85, the basic learning value convergence counter CBSLTD is compared with a predetermined value NBSLTD#, and when CBSLTD≧NBSLTD#, the routine proceeds to a step S86.

In the step S86, a basic learning value convergence flag FBSLTD is set to "1", and the process is terminated.

When CBSLTD<NBSLTD#, in the step S85, the routine proceeds to a step S87, FBSLTD is reset to "0", and the routine is terminated.

Next, the process of looking up the ineffectual pulse width learning value performed by the control unit 2 will be described with reference to the flowchart of FIG. 12.

This process is performed at a fixed interval or as a background job independently of the process of FIG. 3.

Steps S116–S122 are characteristic features of this invention, and will therefore be described in detail hereafter.

In a step S111, an ineffectual pulse width learning value LRNTS0 stored in a backup RAM is entered in a variable LRNTS (msec).

In steps S112–S115, limit processing which will be described herebelow is performed on the variable LRNTS.

In a step S112, an upper limit LTSMAX# (msec) of the ineffectual pulse width learning value is compared with LRNTS. The upper limit LTSMAX# is set to, for example, +0.1 msec.

When LTSMAX#<LRNTS, the routine proceeds to a step S113, and the vale of the variable LRNTS is limited to LTSMAX#. In all other cases, the routine bypasses the step S113 and proceeds to a step S114.

In the step S114, a lower limit LTSMIN# of the ineffectual pulse width learning value (msec) is compared with the value of the variable LRNTS. The lower limit LTSMIN# is set to, for example, −0.1 msec.

When LTSMIN#>LRNTS, the value of the variable LRNTS is limited to LTSMIN# in a step S115 and the process is terminated. When LTSMIN#≦LRNTS, the routine is terminated without proceeding to the step S115.

The flowchart of FIG. 13 shows a process for updating the ineffectual pulse width learning value performed by the control unit 2.

Figure 14:
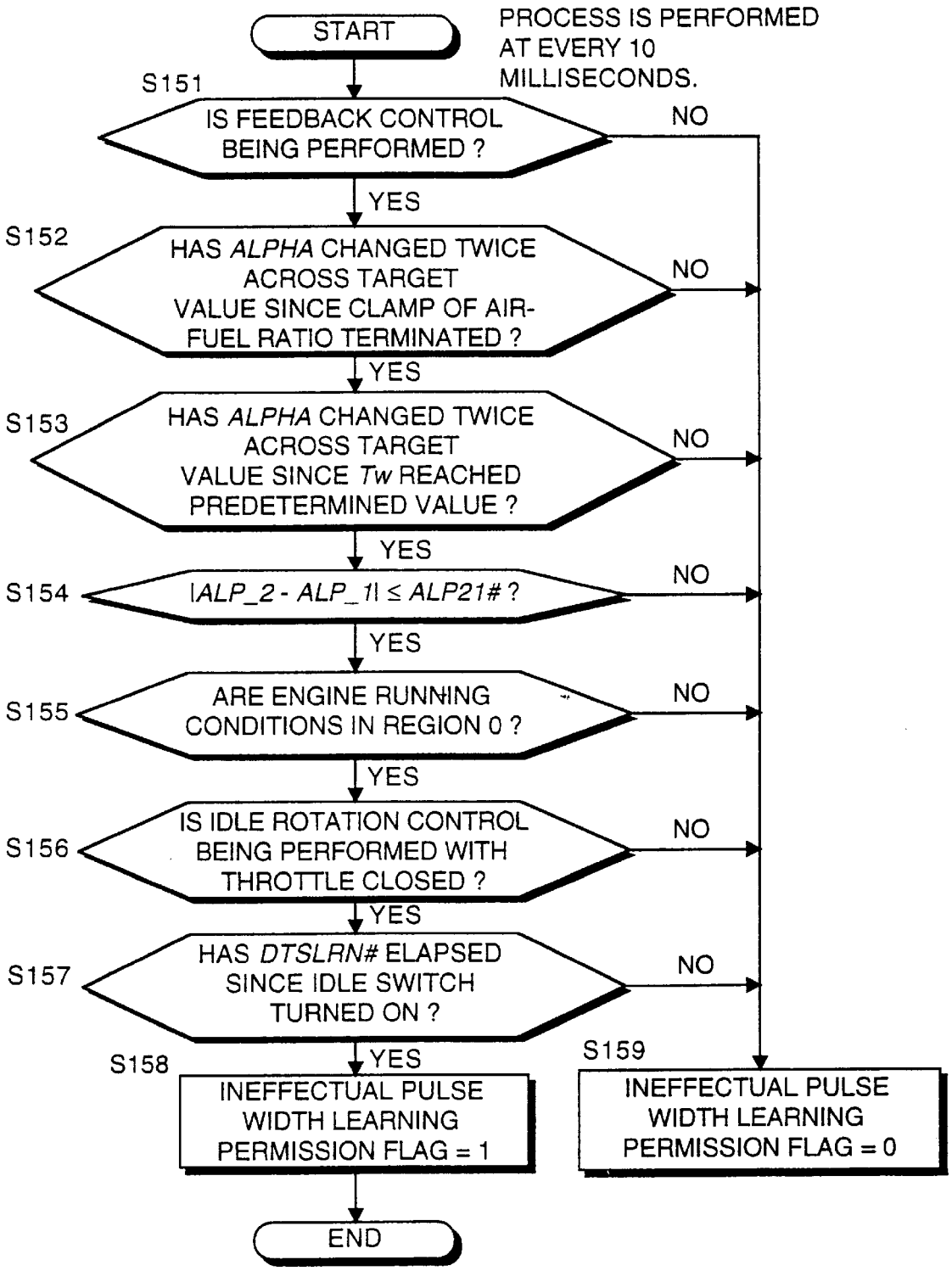
FIG. 14 is a flowchart for describing a process for determining a learning permission condition for the ineffectual pulse width learning value according to the air-fuel ratio controller.

The flowchart of FIG. 14 shows a process for determining learning permission conditions performed by the control unit 2.

The process of FIG. 13 corresponds to the process of FIG. 8 or FIG. 10.

The process of FIG. 14 corresponds to the process of FIG. 9 or FIG. 11.

As in the case of the process of FIG. 8 or FIG. 10, the process of FIG. 13 is performed whenever there is an inversion of the output signal from the O2 sensor 9.

As in the case of the process of FIG. 8 and FIG. 11, the process of FIG. 14 is performed at an interval of, for example, 10 msec.

The method of updating the ineffectual pulse width learning value is basically the same as that of updating the map learning values or basic learning values.

First, in a step S131 of FIG. 13, it is determined whether or not the learning permission conditions hold for learning the ineffectual pulse width from the results of the process of FIG. 14.

The conditions considered in the process of FIG. 14 are as follows.

Step S151: Air-fuel ratio feedback control is being performed.

Step S152: The air-fuel ratio feedback correction coefficient ALPHA has inverted two or more times since ALPHA was not fixed.

Step S153: ALPHA has inverted two or more times since the cooling water temperature Tw has come to be situated within the predetermined range, i.e. TWLCL#≦Tw≦TWLCH#.

Step S154: |ALP_2−ALP_1|≦predetermined value ALP21#.

Step S155: The running region is region 0 shown in FIG. 4.

Step S156: Idle rotation speed control is being performed with the throttle 5 closed.

Step S157: A predetermined time DTSLRN# has elapsed since the idle switch switched from OFF to ON.

In the determination of the learning permission conditions, the steps S151–S154 are the same as the steps S61–S64 of FIG. 9.

In the step S155, learning is permitted only in the learning region 0 because in this region, the proportion of the ineffectual pulse width Ts in the cylinder-specific fuel injection pulse width $CTi_n$ is larger than that of the basic injection pulse width Tp, and in this case therefore, the error in the stoichiometric air-fuel ratio is mainly due to error in Ts. Further, although the basic injection pulse width Tp, i.e. engine load, is small in the regions 4, 8 and 12 shown in FIG. 4, learning of the ineffectual pulse width Ts is not permitted in these regions as fuel cut may be performed. Learning of the ineffectual pulse width learning value Ts cannot be performed during fuel cut.

In the step S156, the reason why learning of the ineffectual pulse width Ts is permitted provided that idle rotation speed control is being performed with the throttle 5 closed, is because the rotation speed and air-fuel ratio are more stable in this state than at other times.

In the step S157, the reason for waiting for a predetermined time to elapse from when the idle switch is switched from OFF to ON, is to stabilize learning values.

In FIG. 14, there are no steps corresponding to the steps S65 and S66 of FIG. 9. This is due to the fact that as learning is limited to the learning region 0, learning of the ineffectual pulse width is limited to when the engine is performing idle rotation, when there is clearly only a small variation of the basic injection pulse width Tp and engine rotation speed n.

When all of the conditions of the steps S151–S157 hold, in a step S158, a learning permission flag of the ineffectual pulse width Ts is set to "1". When any of the conditions do not hold, in a step S159, the learning permission flag is reset to "0".

When the learning permission conditions hold in the step S131 of FIG. 13, the routine proceeds to a step S132. When the learning permission conditions do not hold, the routine terminates without performing the other steps.

In a step S132, it is determined whether or not an average value (ALP_1+ALP_2)/2 of the air-fuel ratio is less than 100 (%). (ALP_1+ALP_2)/2=100 (%) represents the stoichiometric air-fuel ratio.

Comparing with 100% in a step S133, when (ALP_1+ALP_2)/2<100, i.e. when the air-fuel ratio is rich, the ineffectual pulse width learning value is updated in a step S134 by the following equation (12).

$$X3(\text{new})=X3(\text{old})-DLRNTS \quad (12)$$

where, X3(new)=ineffectual pulse width learning value (%) after updating,

X3(old)=ineffectual pulse width learning value (%) before updating,

DLRNTS=updating amount (%).

When (ALP_1+ALP_2)/2≧100 in the step S132, it is also determined whether or not (ALP_1+ALP_2)/2 exceeds 100%, i.e. whether or not the air-fuel ratio is rich, in the step S133. When the air-fuel ratio is rich, the ineffectual pulse width learning value is updated by the following equation (13) in the step S135.

$$X3(\text{new})=X3(\text{old})+DLRNTS \quad (13)$$

where, X3(new)=ineffectual pulse width learning value (%) after updating,

X3(old)=ineffectual pulse width learning value (%) before updating,

DLRNTS=updating amount (%).

When (ALP_1+ALP_2)/2=100, i.e. when the air-fuel ratio is neither lean nor rich, the ineffectual pulse width learning value is updated in a step S136 by the following equation (13).

$$X3(\text{new})=X3(\text{old}) \quad (14)$$

The running region 0 corresponds mainly to idle running, and learning values largely vary during idle running, i.e. when the air-fuel ratio is largely varied, the rotation fluctuation is also large. This is undesirable, so a relatively small value is given to the updating amount DLRNTS.

In a step S137, a limit processing described later is performed on the learning value X3(new).

In a step S138, an ineffectual pulse width learning convergence counter CLTSTD stored in the backup RAM is incremented.

In a step S139, the learning counter CLTSTD is compared with a predetermined value NLTSTD#.

When CLTSTD≧NLTSTD#, the routine proceeds to a step S140, and an ineffectual pulse width learning convergence flag FLTSTD is set to "1".

When CLTSTD<NLTSTD#, the learning convergence flag FLTSTD is reset to "0". The routine then proceeds to a step S142, and all map learning convergence counters CLRNTDi are reset to "0". When the ineffectual pulse width learning value has not converged, CLRNTDi is set equal to 0 so as to repeat learning of all correction coefficients.

The above is a description of air-fuel ratio learning control to which a plurality of learning values having different units are applied.

In recently developed types of air-fuel ratio learning control, limiting values in a predetermined range are provided for all learning values. This is known to absorb manufacturing errors in or time-dependent deterioration of the fuel injector and air flow meter, and suppress errors due to deviation of the air-fuel ratio from the stoichiometric air-fuel ratio as a result of incorrect learning to a relatively low level.

However in an air-fuel ratio controller using both a correction coefficient learning value and an ineffectual pulse width learning value such as in this invention, even if limiting values are individually set for each learning value, the learning values as a whole will lie outside the limits when one learning value is situated in the vicinity of an upper or lower limit.

To deal with this situation therefore, according to this invention, all learning values are limited such that the sum of the ineffectual pulse width learning value percentage in the basic injection pulse width Tp, and the correction coefficient learning value which was originally represented as a percentage of the basic injection pulse width Tp, is situated within ±10%.

The concept of this limit strategy will now be described with reference to FIG. 15B.

Figure 15A:
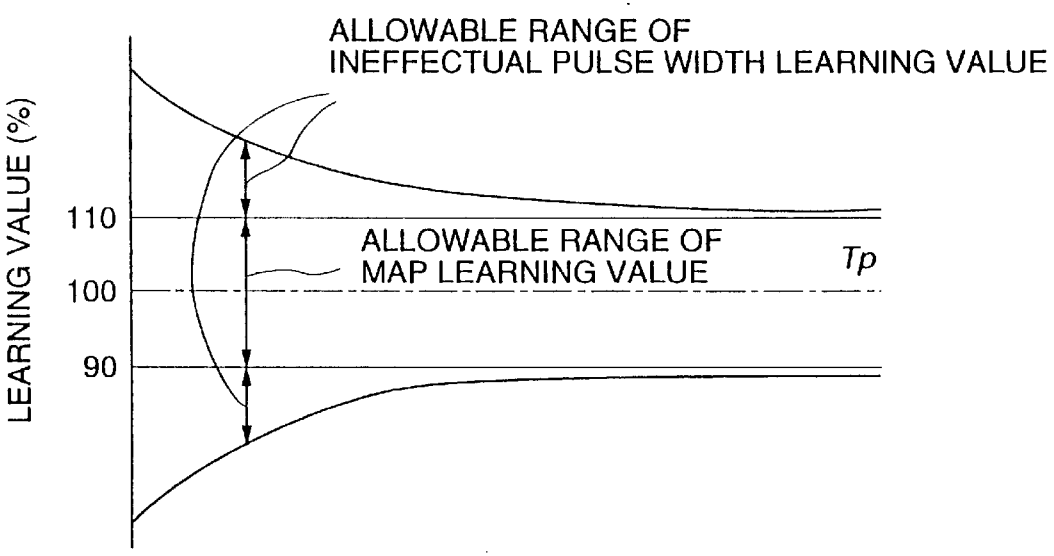
FIG. 15A PRIOR ART
FIGS. 15A and 15B are diagrams which compare a limiting value according to the air-fuel ratio controller with a limiting value according to the prior art.
Figure 15B:
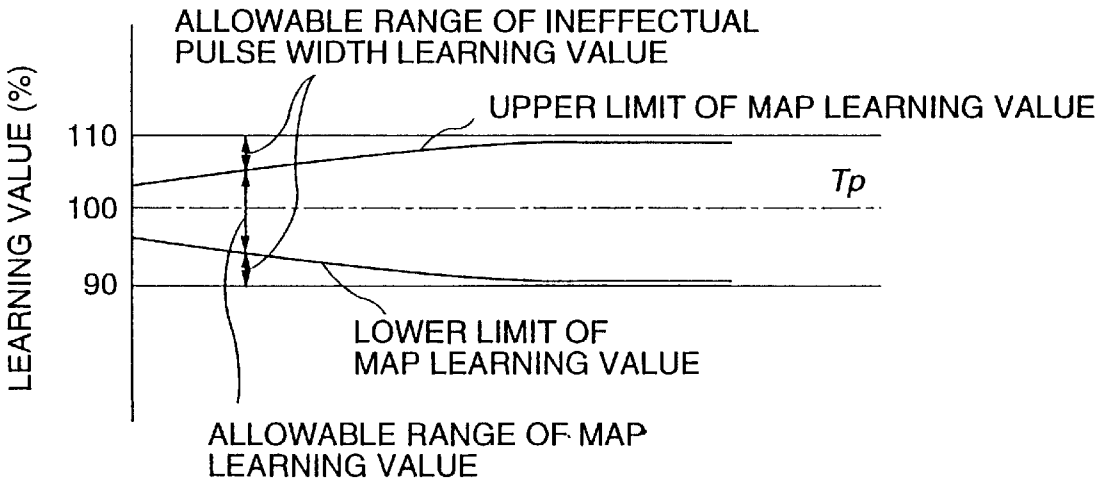

In FIG. 15B, the sum of a value obtained by converting the limiting value of the ineffectual pulse width learning value to a percentage of Tp, and the limiting value of the correction coefficient learning value, is arranged to be 100% ±10%.

The smaller the basic injection pulse width Tp, the larger the proportion of the error in the air-fuel ratio represented by error in the ineffectual pulse width Ts. Therefore, when the permitted range of the aforesaid total amount is 100%±10%, the upper and lower limits of the correction coefficient learning value become smaller the smaller is the basic injection pulse width Tp, as shown in the figure.

Hence, in this air-fuel ratio controller comprising both the ineffectual pulse width learning value which is expressed in injection time units and the correction coefficient learning value which is expressed as a percentage, the sum of these learning values is converted to a percentage and limited to 100%±10%. This prevents a large variation of the air-fuel ratio even when incorrect learning occurs.

The correction coefficient learning value varies depending on the running region, and it has a discontinuous value relative to variation of the basic injection pulse width Tp. The curve shown in FIG. 15B is not therefore necessarily identical to the actual limiting value of the correction coefficient learning value.

Figure 16:
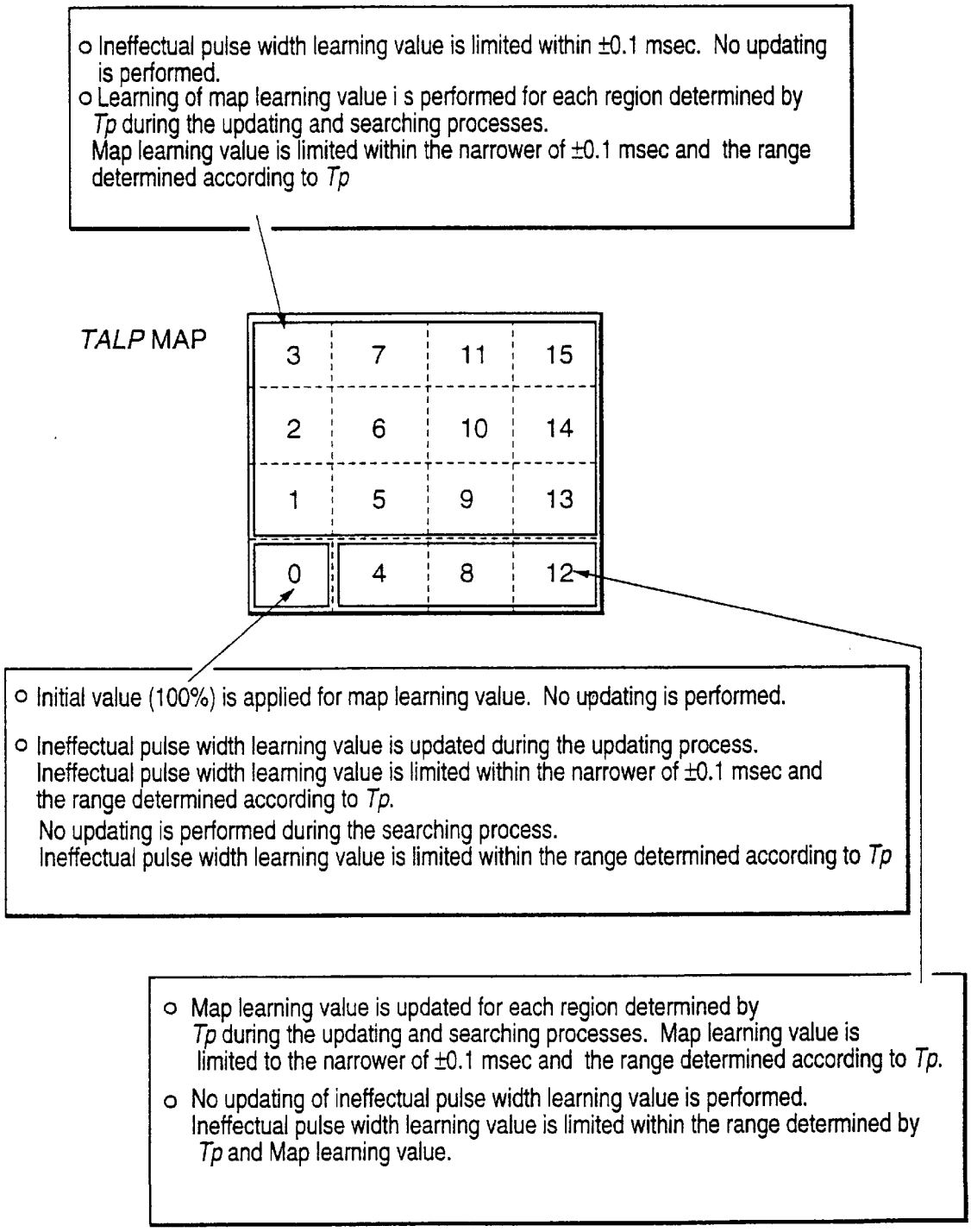
FIG. 16 is a diagram for describing limit processing in various learning regions according to the air-fuel ratio controller.

As shown in FIG. 16, the aforesaid limiting values are set for the correction coefficient learning value and the ineffectual pulse width learning value, limit processing being performed during both updating and searching of learning values for each region.

According to this embodiment, the following steps are added to the control process for performing this limit processing.

(1) Steps S17, S28 for performing the limit processing B2, and steps S21, S25 for performing the limit processing C2, are provided in the process for inspecting the correction coefficient learning value LALPHA shown in FIG. 3.

(2) A step S54 for performing the limit processing B1 is provided in the process for updating the map learning values shown in FIG. 8.

(3) A step S83 for performing the limit processing C1 is provided in the process for updating the basic learning value shown in FIG. 10.

Figure 12:
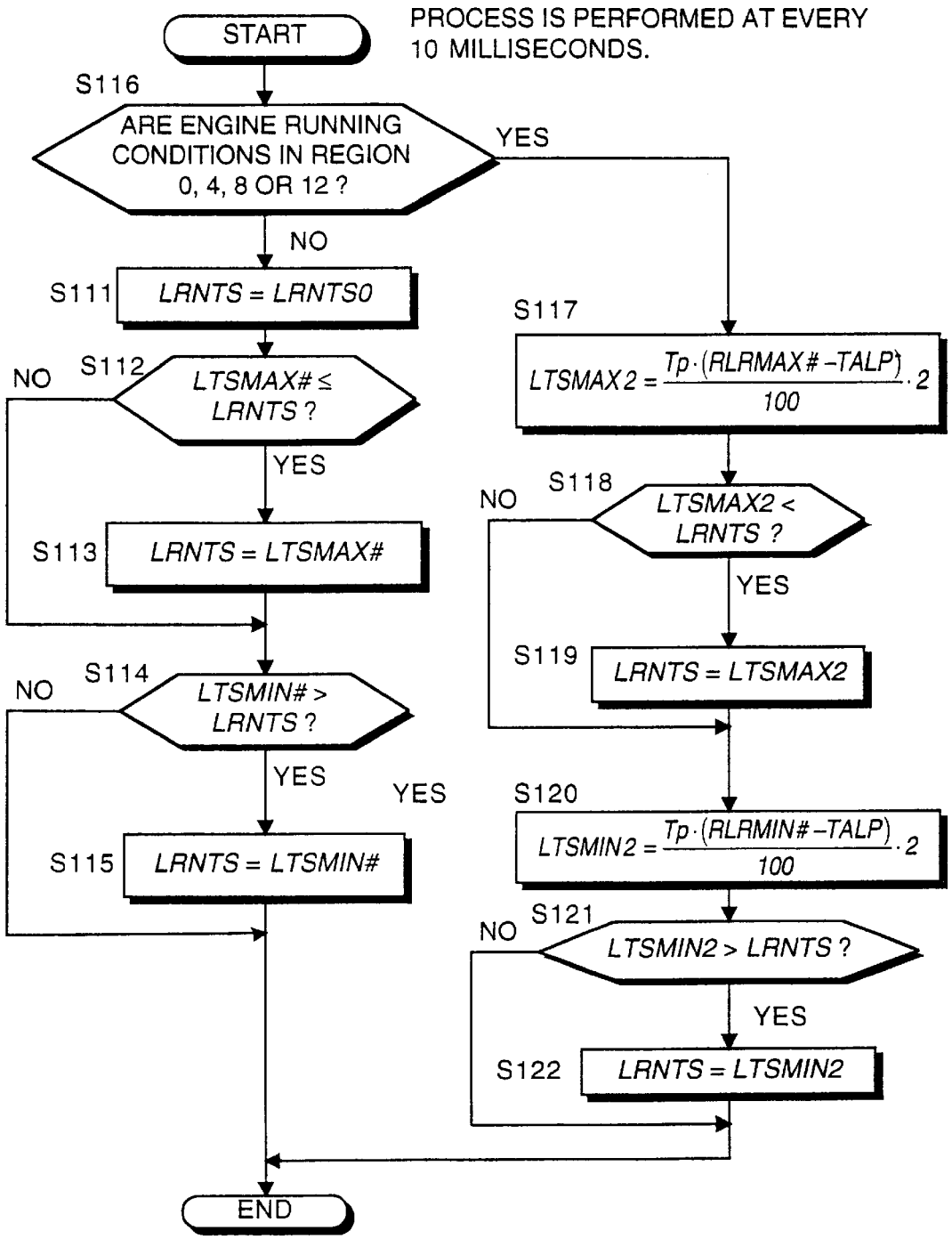
FIG. 12 is a flowchart for describing a process for searching an ineffectual pulse width learning value according to the air-fuel ratio controller.

(4) Steps S116–S122 for performing the limit processing are provided in the process for searching the ineffectual pulse width learning value shown in FIG. 12.

(5) A step S137 for performing the limit processing A is provided in the process for updating the ineffectual pulse width learning value shown in FIG. 13.

FIG. 16 shows the limit processing when a map learning value is selected as the correction coefficient learning value, but even when a basic learning value is selected, limit processing must still be performed on two learning values, i.e. a basic learning value and an ineffectual pulse width learning value. The aforesaid (1)–(5) therefore include also processing of a basic learning value.

Next, the aforesaid (1)–(5) will be separately discussed as shown below.

i. Limit processing during updating of ineffectual pulse width learning value (corresponds to (5) above).

II. Limit processing during application of ineffectual pulse width learning value (corresponds to (4) above.

III. Limit processing during updating and application of map learning value (corresponds to (1) and (2) above).

IV. Limit processing during updating and application of basic learning value (corresponds to (1) and (3) above).

i. Limit processing during updating of ineffectual pulse width learning value

Limit processing during updating of an ineffectual pulse width learning value is the limit processing A of the step S137 of FIG. 13. This processing is performed as a subroutine shown in the flowchart of FIG. 17.

Figure 17:
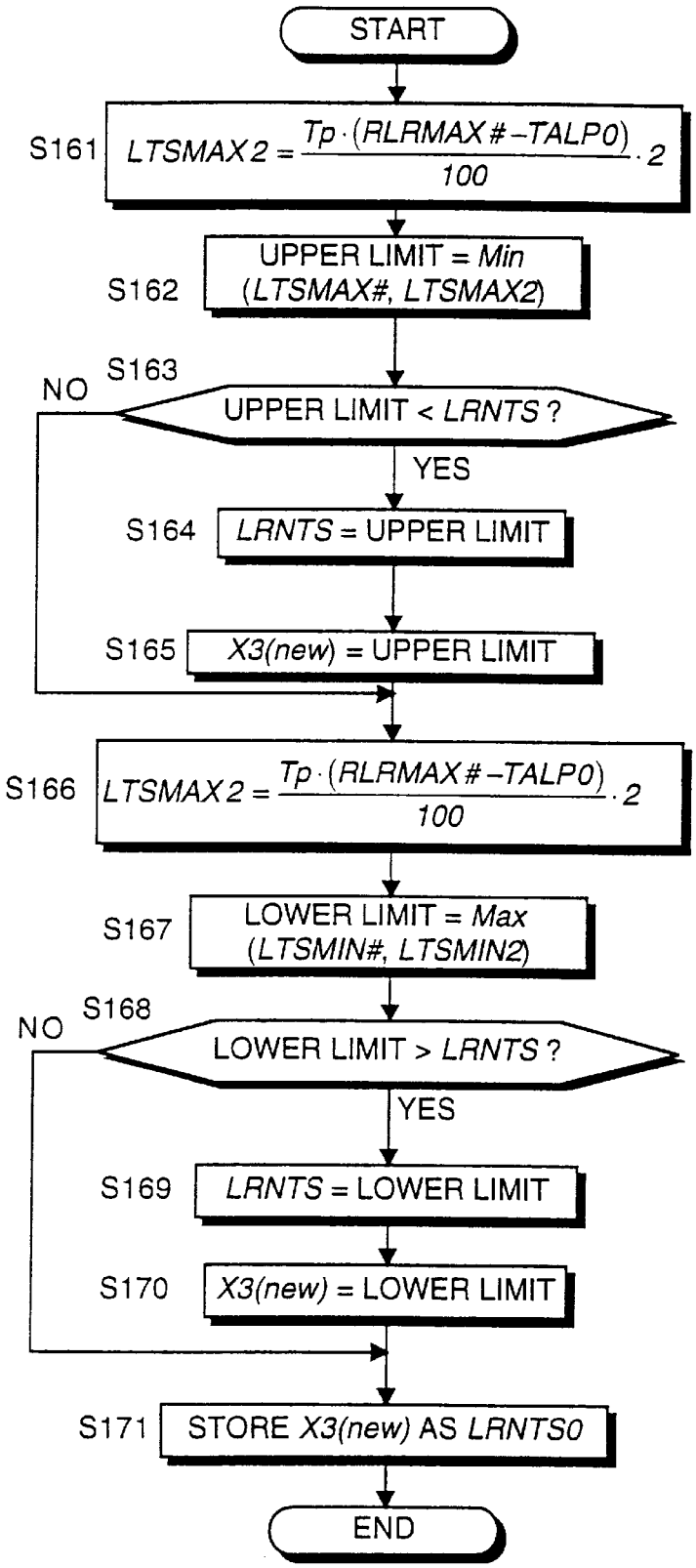
FIG. 17 is a flowchart for describing a limiting value set process during updating of an ineffectual pulse width learning value according to the air-fuel ratio controller.

If the routine proceeds to the step S137 in FIG. 13, after performing all the processing of FIG. 17, the processing of a step S138 and subsequent steps in FIG. 13 is performed.

Steps S161–S165 in FIG. 17 concern upper limit processing, and steps S166–S170 in FIG. 17 concern lower limit processing. As the details of upper limit processing and lower limit processing are similar, mainly upper limit processing will be described herein.

In the step S161, an upper limit LTSMAX2 (msec) of the ineffectual pulse width learning value is calculated by the following equation (15) using the basic injection pulse width Tp obtained in the step S3 of FIG. 2.

$$LTSMAX2 = \frac{Tp \cdot (RLRMAX\# - TALPO)}{100} \cdot 2 \tag{15}$$

where, RLRMAX#=upper limit (%) of learning value sum,

TALP0=fixed value (%) corresponding to map learning value of learning region 0.

Figure 18:
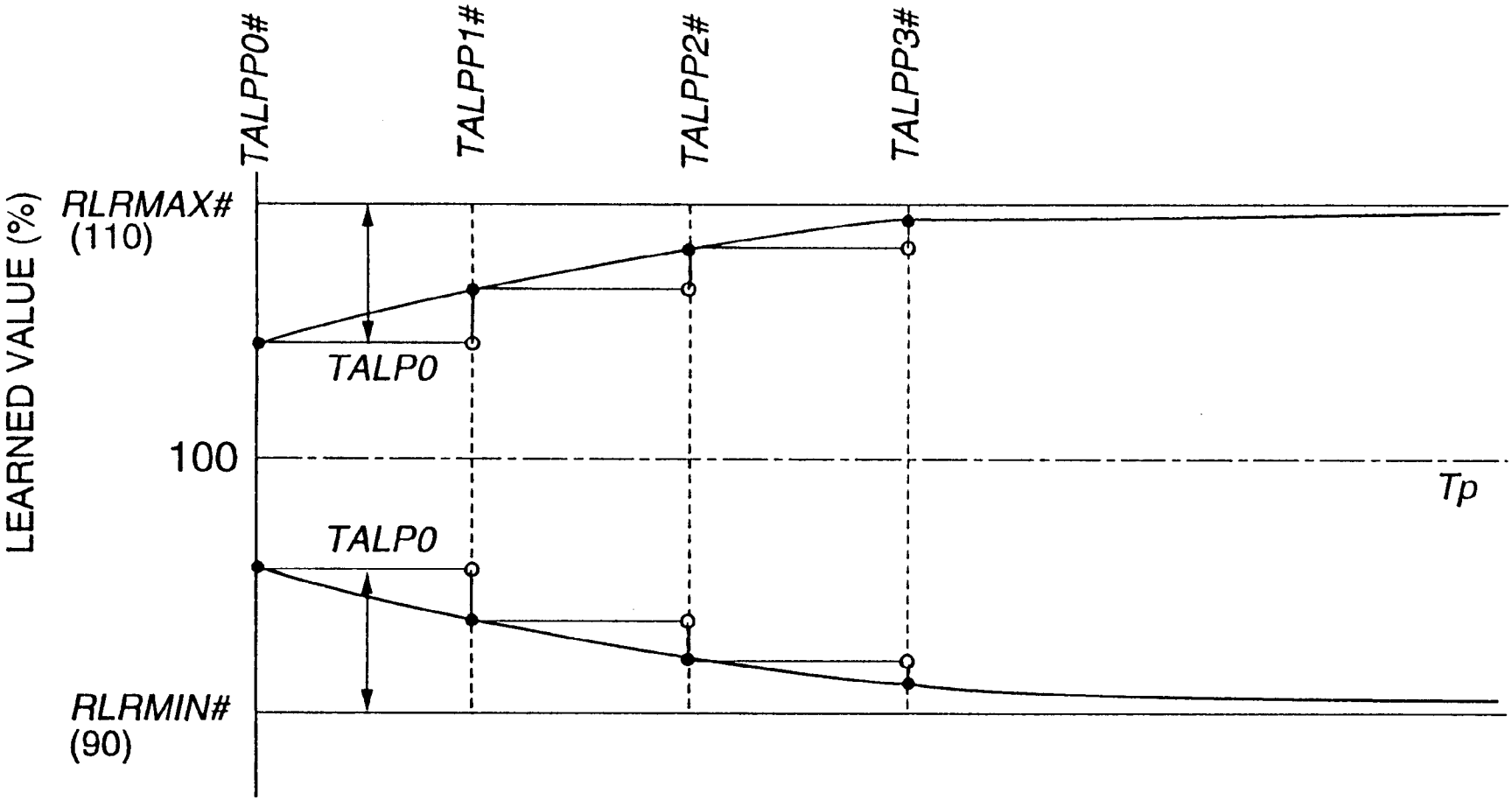
FIG. 18 is a diagram for describing a change of a limiting value of an ineffectual pulse width learning value according to the air-fuel ratio controller.

Herein, the meaning of equation (15) will be explained referring to FIG. 18. FIG. 18 is a diagram which is basically the same as the aforesaid FIG. 15B. In this diagram, a curve which approaches the upper limit RLRMAX# the larger the basic injection pulse width Tp is a boundary line separating a limiting value relative to the ineffectual pulse width learning value and a limiting value relative to the correction coefficient learning value. In actual practice, the correction coefficient learning value is a discontinuous value which is different for each learning region, so the limiting value relative to the correction coefficient learning value varies in a stepwise fashion. At TALPP0#, TALPP1#, TALPP2# and TALPP3# which represent the boundaries of the learning regions, the limiting values take values shown by the black spots.

In the case of the learning region 0, the interval from RLRMAX# to TALP0 shown by the arrow in the figure is acceptable as an upper limit for the ineffectual pulse width learning value. As this value is a percentage, this value is divided by 100 and then the result is multiplied by the basic injection pulse width Tp to obtain the upper limit for the ineffectual pulse width learning value in msec units.

The "2" on the right-hand side of equation (15) is a value corresponding to sequential injection wherein the engine performs fuel injection in a cylinder once in two engine rotations.

In a step S162, the smaller of the computed upper limit LTSMAX2 and the ineffectual pulse width learning value upper limit LTSMAX# (msec) is selected as the upper limit (msec). The reason for making this selection is as follows.

The ineffectual pulse width learning value upper limit LTSMAX# is an upper limit set independently for the ineffectual pulse width learning value, and corresponds to the curve of FIG. 15A. By selecting the smaller of L TSMAX# and LTSMAX2 as the upper limit, the range of the ineffectual pulse width learning value is narrowed, and the effect of incorrect learning is reduced.

When the upper limit has been determined in this way for the ineffectual pulse width learning value, in a step S163, the selected upper limit is compared with the ineffectual pulse width learning value LRNTS.

When LRNTS exceeds this upper limit, the ineffectual pulse width learning value LRNTS is limited to this upper limit in a step S164, then this upper limit is entered in the variable X3(new) in a step S165.

When the ineffectual pulse width learning value LRNTS does not exceed the upper limit in the step S163, the variable X3(new) obtained in the process of FIG. 13 is retained.

In the following step S166, a lower limit LTSMIN2 (msec) of the ineffectual pulse width learning value is calculated by the following equation (16).

$$LTSMIN2 = \frac{Tp \cdot (RLRMIN\# - TALPO)}{100} \cdot 2 \tag{16}$$

where, RLRMIN#=lower limit (%) of learning value sum,

TALP0=correction coefficient learning value (%) in learning region 0.

In a step S167, the larger of the computed lower limit LTSMIN2 and the ineffectual pulse width learning lower limit LTSMIN# (msec) is selected as the lower limit (msec). The ineffectual pulse width learning value lower limit LTSMIN# is a lower limit set independently for the ineffectual pulse width learning value. In a step S168, when the ineffectual pulse width learning value LRNTS is less than the selected lower limit, the ineffectual pulse width learning value LRNTS is limited to this lower limit in a step S169. In a step S170, this lower limit is entered in the variable X3(new).

In a step S168, when the ineffectual pulse width learning value LRNTS is not less than the selected lower limit, the variable X3(new) obtained in the preceding process is retained.

In a step S171, the value of the variable X3(new) is stored in a backup RAM as an ineffectual pulse width learning value LRNTS0.

In other words, even when the variable X3(new) is updated in any of the steps S134–S136 of FIG. 13, the limiting value is set equal to the ineffectual pulse width learning value LRNTS when the ineffectual pulse width learning value exceeds the limiting value in the limiting process A of the step S137.

II. Limit processing during application of ineffectual pulse width learning value Limit processing during application of an ineffectual pulse width learning value is performed by the steps S116–S122 of FIG. 12.

In the step S116 of FIG. 12, the processing of the step S117 and subsequent steps is performed only when the running conditions correspond to any of the learning regions 0, 4, 8, 12.

Upper limit processing is performed in the steps S117–S119, and lower limit processing is performed in the steps S120–S122.

In the step S117, the upper limit LTSMAX2(msec) of the ineffectual pulse width learning value is calculated by the following equation (17).

$$LTSMAX2 = \frac{Tp \cdot (RLRMAX\# - TALP)}{100} \cdot 2 \quad (17)$$

where, RLRMAX#=upper limit (%) of learning value sum,

TALP=correction coefficient learning value (%) in the learning regions 0, 4, 8 and 12.

The computed upper limit LTSMAX2 and ineffectual pulse width learning value LRNTS are compared in the step S118, and when LTSMAX2<LRNTS, the routine proceeds to the step S119 and the value of LTSMAX2 is transferred to LRNTS. When LTSMAX2≧LRNTS, the ineffectual pulse width learning value LRNTS is retained.

In the step S120, the ineffectual pulse width learning lower limit LTSMIN2 (msec) is calculated by the following equation (18).

$$LTSMIN2 = \frac{Tp \cdot (RLRMIN\# - TALP)}{100} \cdot 2 \quad (18)$$

where, RLRMIN#=lower limit (%) of learning value sum,

TALP=correction coefficient learning value (%) in the learning regions 0, 4, 8 and 12.

The computed upper limit LTSMIN2 and ineffectual pulse width learning value LRNTS are compared in the step S121, and when LTSMIN2>LRNTS, the routine proceeds to the step S122 and the value of LTSMIN2 is transferred to LRNTS. When LTSMIN2≦LRNTS, the ineffectual pulse width learning value LRNTS is retained.

Apart from the fact that the correction coefficient learning value is different, the equations (17), (18) are identical to the equations (15), (16).

When the ineffectual pulse width learning value LRNTS is limited by the upper and lower limits, the ineffectual pulse width learning value is not updated by its limiting value.

In other words, there are no steps in the process of FIG. 12 corresponding to the steps S165 and S170 of FIG. 17.

This is due to the following reason. In the learning regions 0, 4, 8, 12, the basic injection pulse width Tp is less than that of other regions. When Tp is small, the values on the right-hand sides of equations (17) and (18) are both small. If the ineffectual pulse width learning value were updated in such a case, the ineffectual pulse width learning value would have a small value. Therefore to avoid this, when the ineffectual pulse width learning value is applied in the learning regions 0, 4, 8 or 12, the updating of the learning value is not performed even when it has been modified by the limitation.

III. Limit processing during updating and application of map learning value

Limit processing during updating of a map learning value is performed by the limit processing B1 of a step S54 of FIG. 8. This limit processing B1 is performed by a subroutine shown in FIGS. 19A and 19B.

In FIG. 19, the learning region is first determined in steps S181 and S182. The learning regions herein are divided into four parts A0, A1, A2, A3 based only on the basic injection pulse width Tp as shown in FIG. 4. For example, the learning region A0 comprises the learning regions 0, 4, 8, 12.

When the running conditions are situated in the learning region A0 or A1, the processing of the steps S183–S193 is performed. When the learning region is situated in A2, the processing of the steps S194–S204 is performed. When the learning region is situated in A3, the processing of the steps S205–S215 is performed. Of these steps, the steps S183–S187, S194–S198 and S205–S209 are upper limit processing, and the processing of the steps S188–S192, S199–S203 and S210–S214 are lower limit processing.

As upper limit and lower limit processing are similar, herein mainly upper limit processing will be described.

In the steps S183, S194, S204, upper limits RLMAX1(%), RLMAX2(%), RLMAX3(%) are calculated respectively for each learning region by the following equations (19), (20), (21).

Learning regions A0, A1:

$$RLMAX1 = RLRMAX\# - \frac{LRNTSO}{TALPP1\# \cdot 2} \cdot 100 \quad (19)$$

Learning region A2:

$$RLMAX2 = RLRMAX\# - \frac{LRNTSO}{TALPP2\# \cdot 2} \cdot 100 \quad (20)$$

Learning region A3:

$$RLMAX3 = RLRMAX\# - \frac{LRNTSO}{TALPP3\# \cdot 2} \cdot 100 \quad (21)$$

where, RLRMAX#=upper limit (%) of learning value sum,

LRNTS0=ineffectual pulse width learning value (msec) stored in backup RAM

In the steps S184, S195 and S206, these upper limits are compared with the upper limit RLRMAX# in the learning value sum, and the smallest of these is set equal to the upper limit. For example in the step S184, it is determined whether the upper limit should be set to RLMAX1 or RLRMAX# depending on whether the value of the ineffectual pulse width learning value LRNTS0 is positive or negative. The same is true of the other steps S195 and S206.

Herein, taking equation (19) as an example, the reason for using TALPP1# as the lower limit of the learning region A1 on the right-hand side will be described referring to FIG. 20.

In the learning region A1, when the basic injection pulse width Tp is equal to Tp1, the limiting value of the ineffectual pulse width learning value corresponds to the second term of equation (19). The upper limit for the map learning value is obtained by subtracting this amount from the limiting value RLRMAX# of the learning value sum using equation (22).

$$\text{Upper Limit} = RLRMAX\# - \frac{LRNTSO}{Tp1 \cdot 2} \cdot 100 \quad (22)$$

In the same learning region A1, when the basic injection pulse width Tp2 is less than Tp1, the upper limit for the map learning value is obtained by the following equation (23).

$$\text{Upper Limit} = RLRMAX\# - \frac{LRNTSO}{Tp2 \cdot 2} \cdot 100 \quad (23)$$

Figure 20:
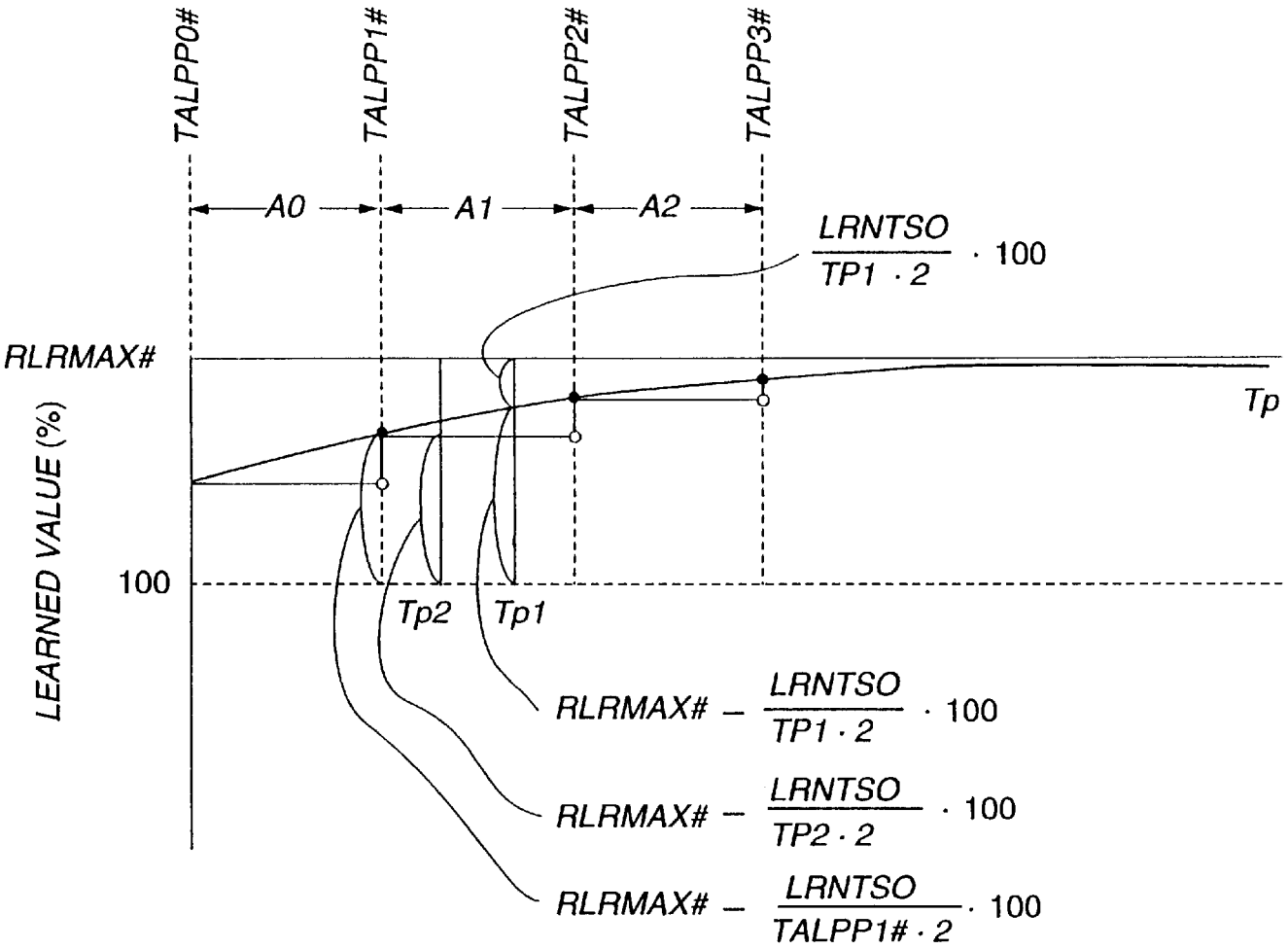
FIG. 20 is a diagram for describing a change of a limiting value of the map learning value according to the air-fuel ratio controller.

When it is assumed that the ineffectual pulse width learning value LRNTS0 is a positive value, since the basic injection pulse width Tp is less than Tp1, the upper limit for the map learning value is also small as shown in FIG. 20. Therefore, if the upper limit obtained in equation (23) were applied to the whole of the learning region A1, the upper limit of the map learning value would become enormous in a region where the basic injection pulse width is less than Tp1, and as a result, the sum of the map learning value and ineffectual pulse width learning value might exceed the upper limit RLRMAX#. In the learning region A1, therefore, TALPP1# which is the minimum basic injection pulse width is used in the calculation of the upper limit.

However, the same TALPP1# as for the learning region A1 is used in the calculation of the upper limit in the learning region A0. This is due to the fact that in the learning region A0, as TALPP0# is 0, the second term of equation (19) cannot be calculated if TALPP0# is used. Further, as the processing of the aforesaid steps S117–S122 limits the ineffectual pulse width learning value in the learning region A0, there is little possibility that the sum of learning values will exceed the upper and lower limits even if the same TALPP1# as in the learning region A1 is used to calculate the map learning upper limit in the learning region A0.

Figure 19A:
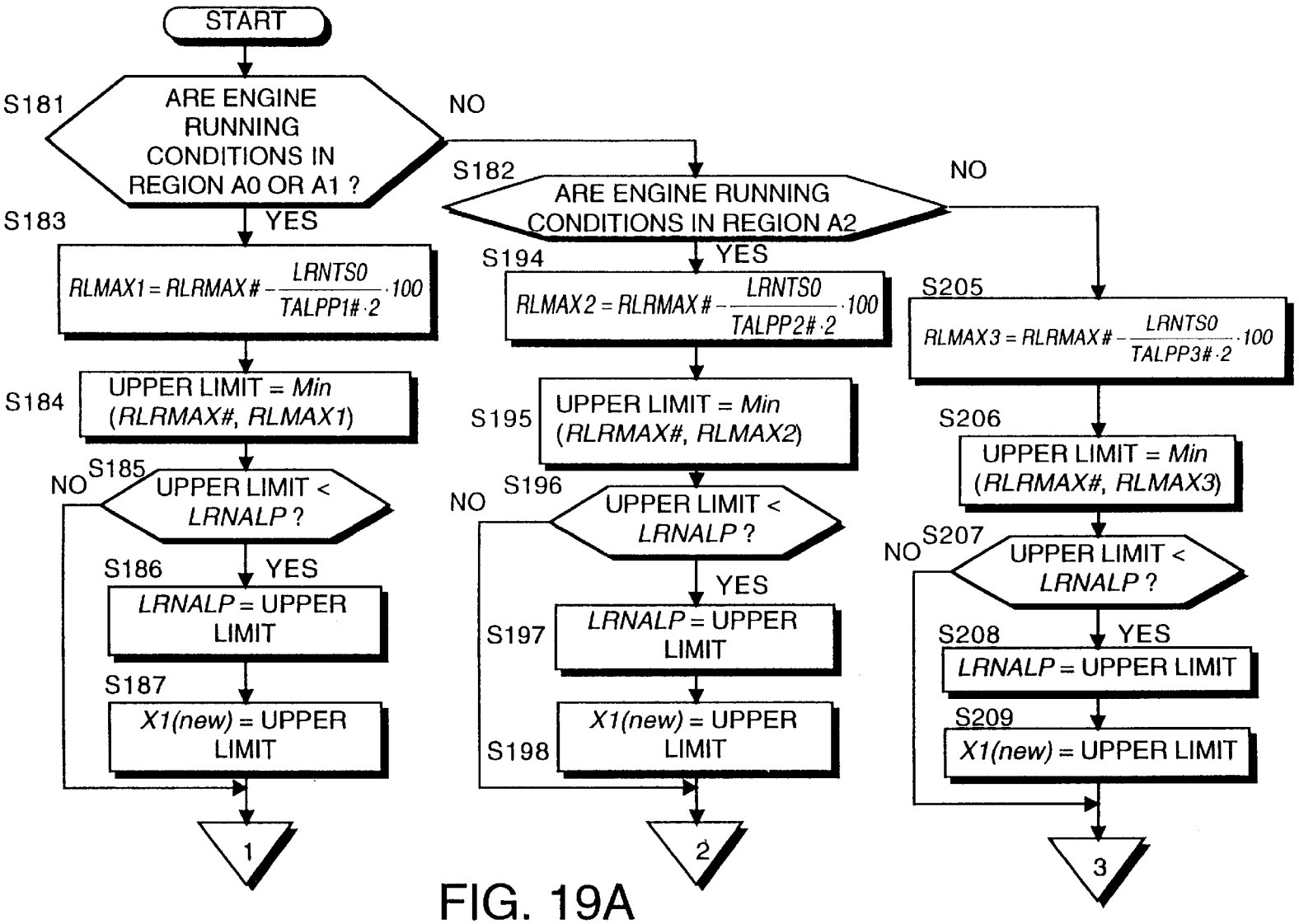
FIGS. 19A and 19B are flowcharts for describing a limiting value set process during updating of the map learning value according to the air-fuel ratio controller.

Returning now to the description of FIG. 19A, the upper limit is compared with a variable LRNALP in steps S185, S196 and S207, and when upper limit <LRNALP, the upper limit is entered in LRNALP in steps S186, S197 and S208. This upper limit is also transferred to the variable X1(new) in steps S187, S198 and S209.

Figure 19B:
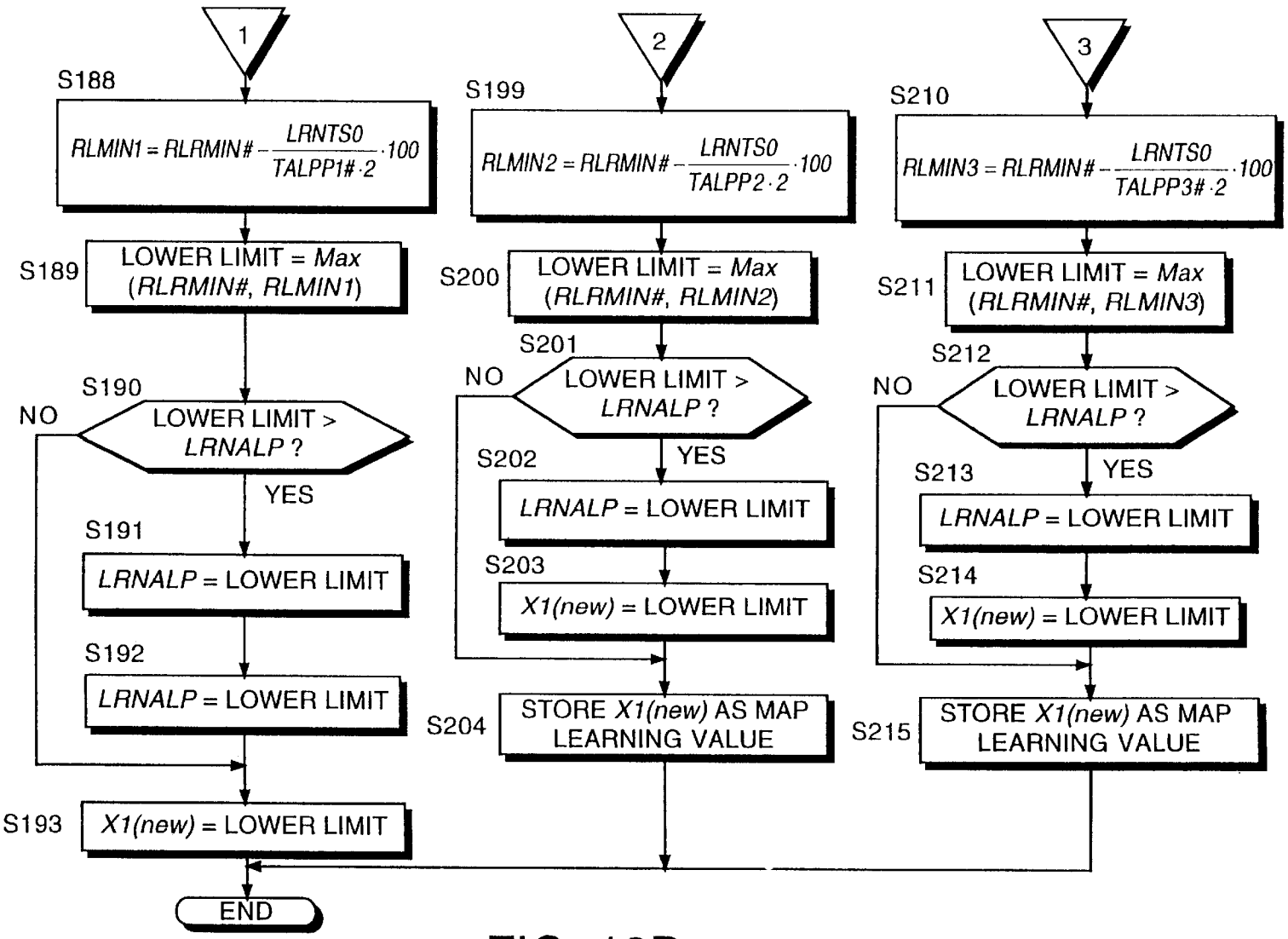

In steps S188–S192, S199–S203 and S210–S214 of FIG. 19B, lower limit processing for each learning region is performed on the learning values in the same way as the aforesaid upper limit processing.

In steps S193, S204 and S215, the value of the variable X1(new) is stored as a map learning value TALP for the corresponding learning region. The learning region in this case does not comprise A0, A1, A2, A3, but regions 1–15 of FIG. 4.

Specifically, even if the map learning value is updated in the step S53 of FIG. 8 during updating of map learning values, when the variable LRNALP is limited by the limiting value in the limiting process B1 of the step S54, the map learning value is further updated by this limiting value.

Next, limit processing when the map learning value is applied, is performed by the limit processing B2 of the steps S17, S28 of FIG. 3.

This limit processing B2 is also identical to the limit processing B1 shown in FIGS. 19A and 19B.

In the limit processing B2, after entering the upper and lower limits in the variable X1(new) in the steps S187, S192, S198, S203, S209 and S214 of FIGS. 19A and 19B, the upper and lower limits are directly stored as corresponding learning region map learning values instead of storing the value of X1(new) as a map learning value for the corresponding learning region in the steps S193, S204 and S215.

Specifically, the variable LRNALP is limited by upper and lower limits even when the map learning value is applied, and when LRNALP is limited, the map learning value is updated by the limiting values.

The reason for updating the map learning value in this way even when the map learning value is applied, is that the sum of the map learning value and the ineffectual pulse width learning value can be constrained to lie within the upper and lower limits RLRMAX#, RLRMIN#, only by updating both learning values to the most recent values with the same timing.

However, as the learning permission conditions are different for these two learning values, they are not updated with the same timing.

Due to this difference in the update timing, there is a possibility that the sum of the two learning values may exceed the upper and lower limits RLRMAX#, RLRMIN#. Therefore, if they are limited even when the map learning value is used, the number of updating occasions is increased as far as possible.

In this way, the sum of the learning values does not drift outside the upper and lower limits RLRMAX#, RLRMIN#.

IV. Limit processing during updating and application of basic learning value

Limit processing during updating of the basic learning value is performed by the limit processing C1 of the step S83 of FIG. 10, and limit processing during application of the basic learning value is performed by the limit processing C2 of the steps S21, S25 of FIG. 3.

The limit processing C1 will be described referring to the flowchart of FIG. 21. This process is performed as a subroutine corresponding to the step S83 of FIG. 10.

The limit processing C2 will be described referring to the flowchart of FIG. 22. This process is performed as a subroutine corresponding to the steps S21, S25 of FIG. 3.

Figure 5:
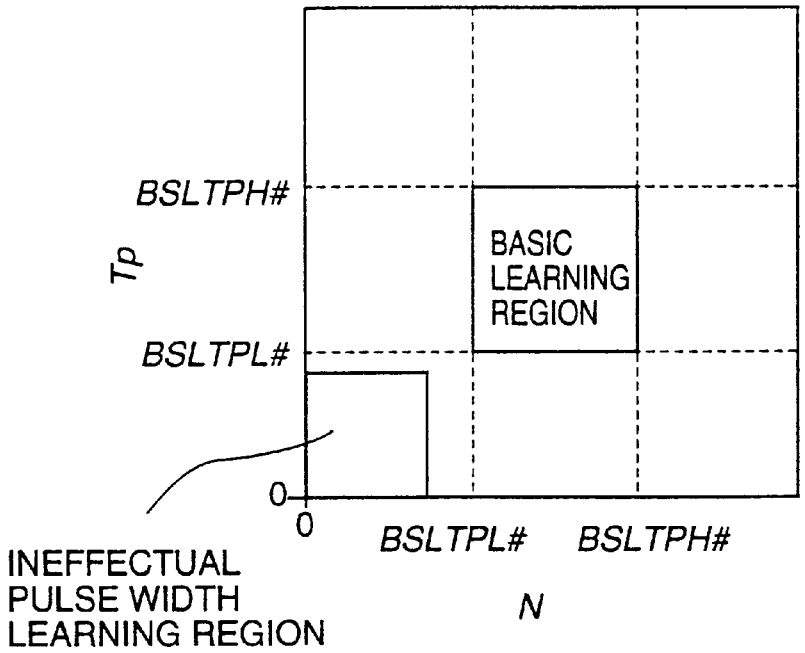
FIG. 5 is a diagram describing a learning region of a basic learning value set by the air-fuel ratio controller.

The limit processing during update of the basic learning value and the limit processing during update of the map learning value are basically identical. However, as the basic learning value has only one learning region as shown in FIG. 5 unlike the map learning value, the upper and lower limits of the basic learning value are calculated by the following equations (24), (25) in steps S221, S226 of FIG. 21.

$$RLMAX0 = RLRMAX\# - \frac{LRNTSO}{BSLTPL\# \cdot 2} \cdot 100 \tag{24}$$

$$RLMIN0 = RLRMIN\# - \frac{LRNTSO}{BSLTPL\# \cdot 2} \cdot 100 \tag{25}$$

where, RLMAX0=upper limit (%) of basic learning value,

RLMIN0=lower limit (%) of basic learning value,

RLRMAX#=upper limit (%) of learning value sum,

RLRMIN#=lower limit (%) of learning value sum,

LRNTS0=ineffectual pulse width learning value (msec),

BSLTPL#=basic injection pulse width Tp which is lower limit of basic learning permission conditions.

Figure 23:
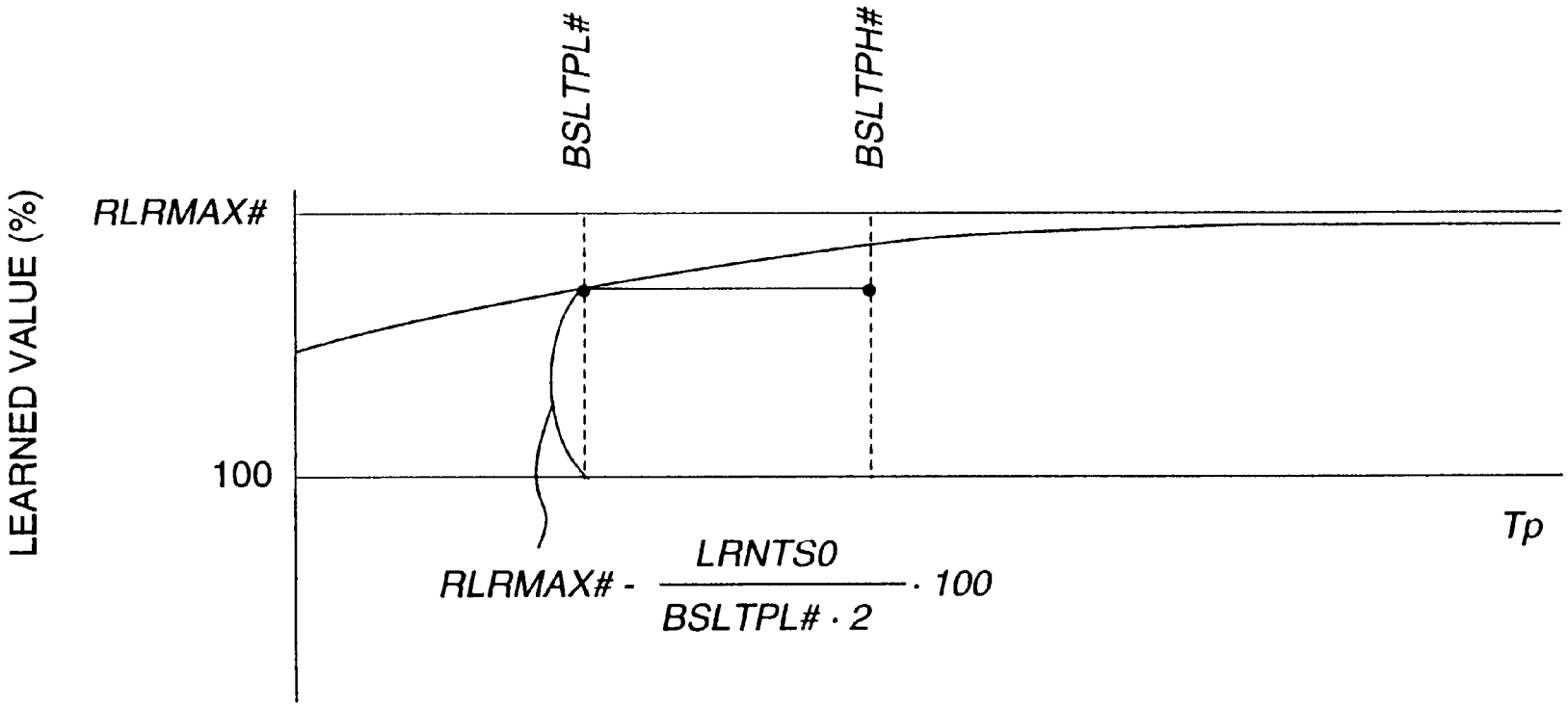
FIG. 23 is a diagram for describing a limiting value change in searching the basic learning value according to the air-fuel ratio controller.

Herein, the reason why the denominator of the second term on the right-hand side of equations (24), (25) is not Tp·2 but BSLTPL#·2 is the same as the reason why the denominator of the second term on the right-hand side in the step S183 of FIG. 19 and the step S188 of FIG. 19B is not Tp·2 but TALPP1#·2. As shown in FIG. 23, the basic learning value within the learning region is kept small by applying the minimum value BSLTPL# within the region.

Figure 22:
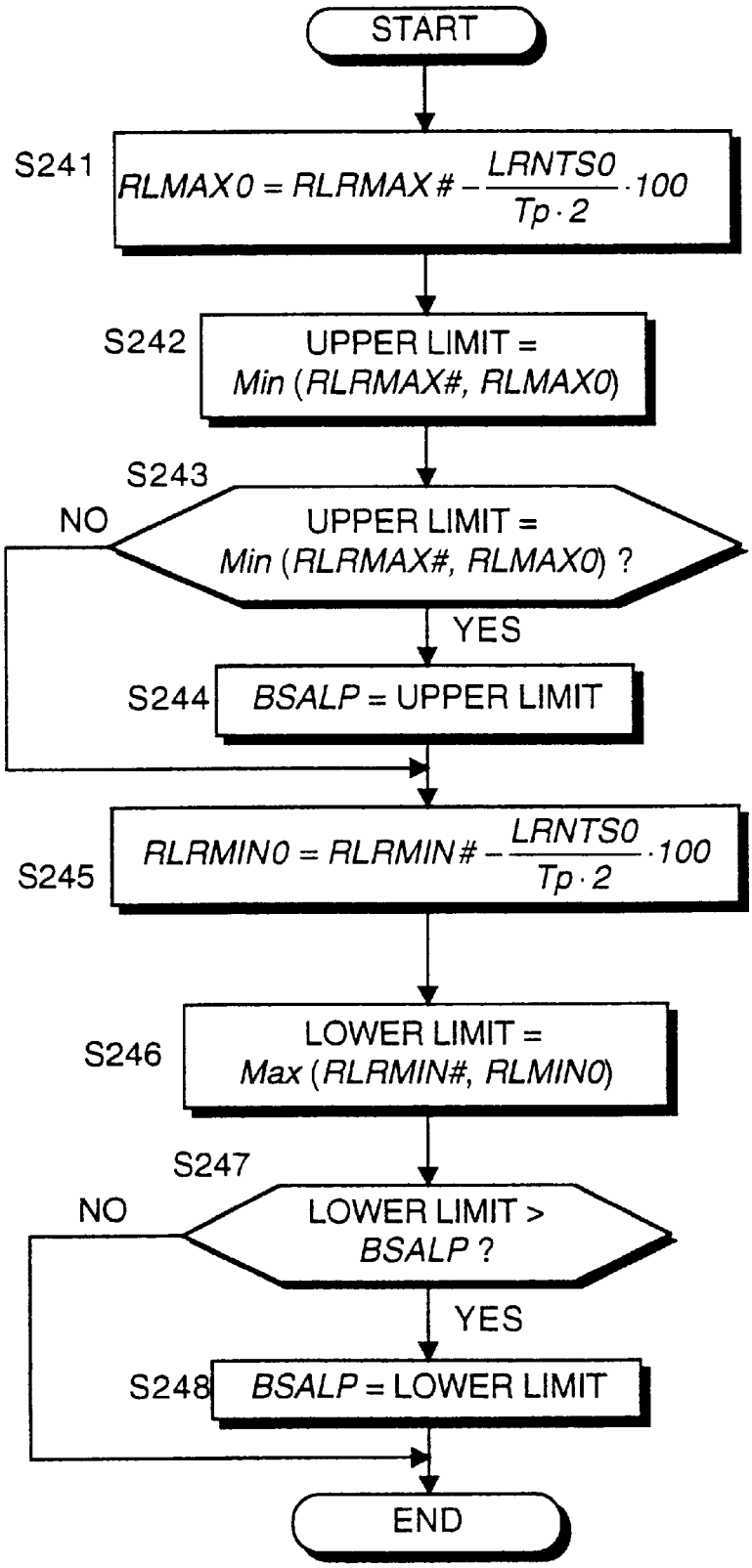
FIG. 22 is a flowchart for describing a limiting value set process in searching the basic learning value according to the air-fuel ratio controller.

On the other hand, the upper and lower limits of the basic learning value during application of the basic learning value are calculated by the following equations (26), (27) in the steps S241, S245 of FIG. 22.

$$RLMAX0 = RLRMAX\# - \frac{LRNTSO}{Tp \cdot 2} \cdot 100 \tag{26}$$

$$RLMIN0 = RLRMIN\# - \frac{LRNTSO}{Tp \cdot 2} \cdot 100 \tag{27}$$

where, RLMAX0=upper limit (%) of basic learning value,

RLMIN0=lower limit (%) of basic learning value,

RLRMAX#=upper limit (%) of learning value sum,

RLRMIN#=lower limit (%) of learning value sum,

LRNTS0=ineffectual pulse width learning value.

In a step S242, the smaller of the obtained upper limit RLMAX0 and the upper limit RLRMAX# of the learning value sum is used as the upper limit. Similarly, in a step S246, the larger of the lower limit RLMIN0 and the lower limit RLRMIN# of the learning value sum is used as the lower limit.

The basic learning value BSALP is limited by the upper limit and lower limit chosen in this way as shown by the steps S243, S244 and S247, S248.

Figure 21:
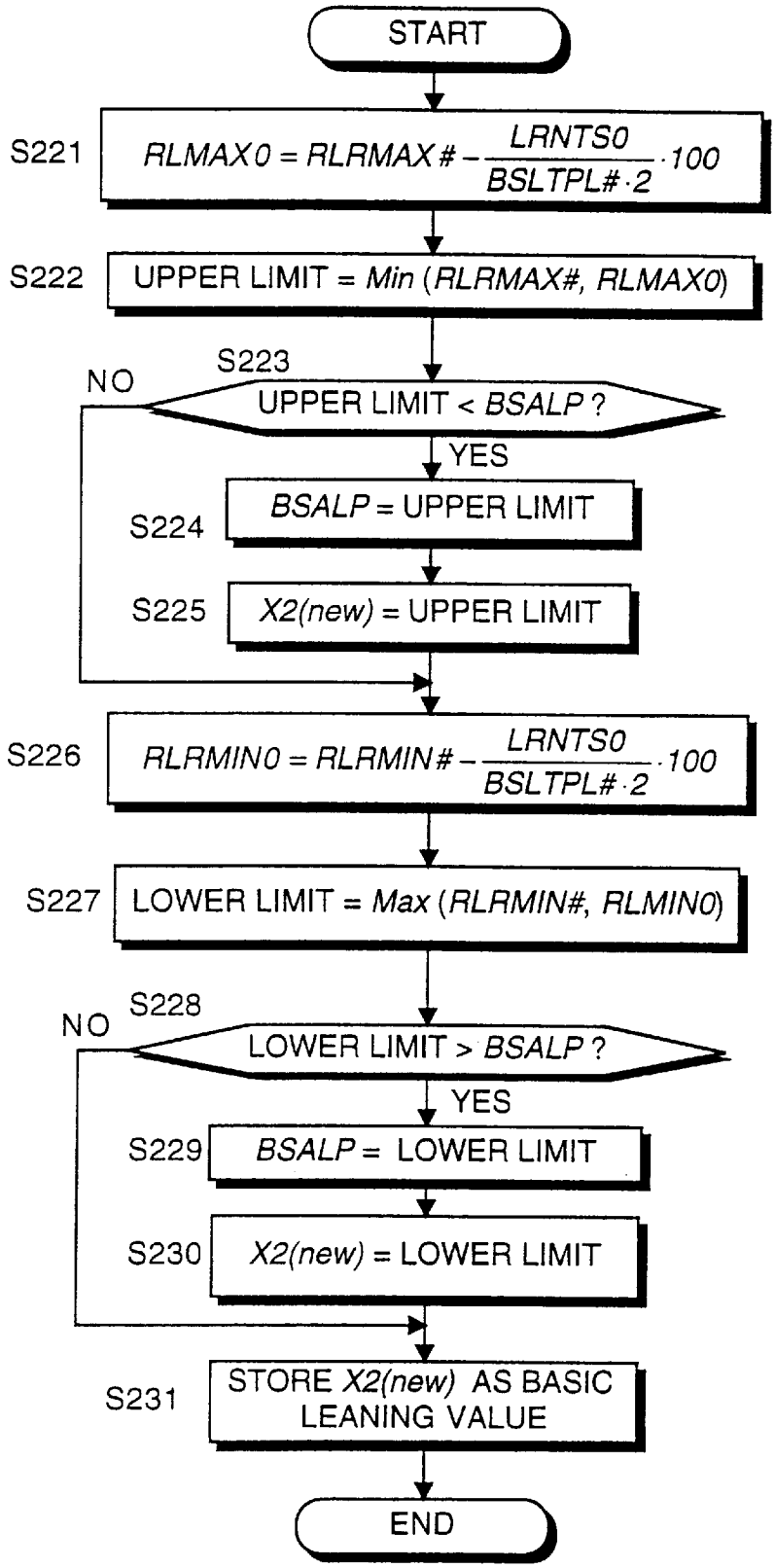
FIG. 21 is a flowchart for describing a limiting value set process during updating of a basic learning value according to the air-fuel ratio controller.

However, even when limits are applied in the application of the basic learning value, the value is not updated by the limiting value, i.e. there are no steps corresponding to the steps S225, S230 and S231 of FIG. 21 in the process of FIG. 22. This is due to the following reason.

When Tp approaches 0 in the equations (26), (27), the second term on the right-hand side increases and the value of the right-hand side approaches 100%.

If the basic learning value were updated when the value is near 100% as described, the basic learning value would be an extremely small value. Therefore when the basic learning value is applied, updating of the basic learning value is not performed.

According to this embodiment, the upper limit RLRMAX# and lower limit RLRMIN# of the learning value sum are set equal to 110% which is the upper limit and 90% which is the lower limit specific to the correction coefficient learning value. The upper limit RLRMAX# and lower limit RLRMIN# may however be set to values different from the upper and lower limits specific to the correction coefficient learning value.

According to this embodiment, a controller was described wherein the ineffectual pulse width learning value was applied as a learning value of an addition term, and the map learning value or basic learning value was applied as a learning value of a multiplying term. This invention may however be applied to any combination of addition learning values and multiplication learning values.

The embodiments of this invention in which an exclusive property or privilege is claimed are defined as follows:

1. An engine air-fuel ratio controller, comprising:

a fuel injector for injecting fuel for providing an air-fuel mixture to an engine, a first sensor for detecting an engine load, a second sensor for detecting an engine rotation speed, and a microprocessor programmed to:

calculate a basic injection amount based on said engine load and said engine rotation speed, pre-store a learning value of a multiplication term for correcting said basic injection amount by multiplying said learning value of said multiplication term and said basic injection amount, pre-store a learning value of an addition term for correcting said basic injection amount by adding said learning value of said addition term to said basic injection amount, convert said learning value of said addition term to a proportion relative to said basic injection amount, modify said learning values so that the sum of said proportion and said learning value of said multiplication term is within a predetermined range, calculate a target fuel injection amount from said basic injection amount and said modified learning values, and control said fuel injector so that an injection amount of said fuel injector coincides with said target injection amount.

2. An engine air-fuel ratio controller, comprising:

a fuel injector for injecting fuel for providing an air-fuel mixture to an engine, a first sensor for detecting an engine load;

a second sensor for detecting an engine rotation speed, a third sensor for detecting an air-fuel ratio of said air-fuel mixture, and a microprocessor programmed to:

calculate a basic injection amount based on said engine load and said engine rotation speed, calculate a feedback correction amount of said basic injection amount such that an air-fuel ratio coincides with a predetermined target air-fuel ratio, learn a multiplication term for correcting said basic injection amount by multiplying said multiplication term and said basic injection amount, learn an addition term for correcting said basic injection amount by adding said addition term to said basic injection amount, based on said feedback correction amount, convert said learned addition term to a proportion relative to said basic injection amount, modify said learned multiplication term and said learned addition term such that the sum of said proportion and said learned multiplication term, is within a preset first range (RLRMAX#, RLRMIN#), calculate a target fuel injection amount based on said basic injection amount and said modified multiplication term and said modified addition term, and control said fuel injector so that an injection amount of said fuel injector coincides with said target injection amount.

3. An air-fuel ratio controller as defined in claim 2, wherein said microprocessor is programmed to modify said learned addition term such that said learned addition term lies within a second range (LTSMAX2, LTSMIN2), and modify said multiplication term based on a modified addition term.

4. An air-fuel ratio controller as defined in claim 3, wherein said microprocessor is programmed to calculate said proportion based on said modified addition term, and to modify said multiplication term such that the sum of said proportion and said multiplication term lies within said first range (RLRMAX#, RLRMIN#).

5. An air-fuel ratio controller as defined in claim 3, wherein said second range (LTSMAX2, LTSMIN2) is specified as a fuel injection amount.

6. An air-fuel ratio controller as defined in claim 2, wherein said microprocessor is programmed to modify said learned addition term such that said learned addition term lies within the narrower of said second range (LTSMAX2, LTSMIN2) and a range (LTSMAX#, LTSMIN#) specified by predetermined fixed values, and modify said multiplication term based on a modified addition term.

7. An air-fuel ratio controller as defined in claim 2, wherein said microprocessor is programmed to modify said learned addition term such that said learned addition term lies within said second range (LTSMAX2, LTSMIN2), convert a modified addition term to said proportion, and modify said multiplication term such that the sum of said proportion and said multiplication term lies within said first range (RLRMAX#, RLRMIN#).

8. An air-fuel ratio controller as defined in claim 2, wherein said microprocessor is further programmed to learn said addition term but not learn said multiplication term under a predetermined engine running condition.

9. An-air-fuel ratio controller as defined in claim 8, wherein said predetermined engine running condition is that said engine load is equal to or less than a predetermined value and said engine rotation speed is equal to or less than a predetermined value.

10. An air-fuel ratio controller as defined in claim 2, wherein said microprocessor is further programmed to learn said multiplication term for each of plural running regions determined according to said engine load and said engine rotation speed.

11. An air-fuel ratio controller as defined in claim 10, wherein said microprocessor is programmed to modify said learned addition term such that said learned addition term lies within a second range (LTSMAX2, LTSMIN2), determine said proportion based on a value obtained by dividing a modified addition term by a minimum value of said basic injection amount in a running region, and modify said multiplication term such that the sum of said proportion and said multiplication term lies within said first range (RLRMAX#, RLRMIN#).

12. An air-fuel ratio controller as defined in claim 10, wherein said microprocessor is programmed to modify said learned addition term such that said learned addition term lies within a second range (LTSMAX2, LTSMIN2), determine said proportion based on a value obtained by dividing a modified addition term by a minimum value of said basic injection amount in a running region, and modify said multiplication term such that the sum of said proportion and said multiplication term lies within said first range (RLPMAX#, RLRMIN#), and such that said multiplication term lies within said first range (RLRMAX#, RLRMIN#).

13. An air-fuel ratio controller as defined in claim 2, wherein said microprocessor is programmed to modify said learned multiplication term and said learned addition term at a timing when said microprocessor learns said multiplication term and said addition term.

14. An air-fuel ratio controller as defined in claim 2, wherein said microprocessor is programmed to modify said learned multiplication term and said learned addition term at a timing when said microprocessor calculates said target fuel injection amount.

15. An air-fuel ratio controller as defined in claim 14, wherein said microprocessor is further programmed to relearn modified values when said microprocessor modifies said learned multiplication term and said learned addition term.

16. An air-fuel ratio controller as defined in claim 9, wherein said microprocessor is further programmed to modify said learned addition term such that said learned addition term lies within a second range (LTSMAX2, LTSMIN2), modify said multiplication term based on a modified addition term, and modify said second range (LTSMAX2, LTSMIN2) based on a modified multiplication term when said engine load is equal to or less than a predetermined value, and said engine rotation speed is equal to or greater than a predetermined value.

17. An engine air-fuel ratio controller for use with an engine provided with a canister for adsorbing fuel vapor in a fuel tank and a fuel vapor processor for supplying adsorbed fuel in said canister to said engine, said controller comprising:

a fuel injector for injecting fuel for providing an air-fuel mixture to said engine, a first sensor for detecting an engine load;

a second sensor for detecting an engine rotation speed, a third sensor for detecting an air-fuel ratio of said air-fuel mixture, and a microprocessor programmed to:

calculate a basic injection amount based on said engine load and said engine rotation speed, calculate a feedback correction amount of said basic injection amount such that an air-fuel ratio coincides with a predetermined target air-fuel ratio, determine whether or not fuel supply from said fuel vapor processor to said engine has stopped, learn a multiplication term for correcting said basic injection amount by multiplying said multiplication term and said basic injection amount, based on said feedback correction amount, when fuel supply from said fuel vapor processor to said engine has stopped, learn an addition term for correcting said basic injection amount by adding said addition term to said basic injection amount, based on said feedback correction amount, convert said learned addition term to a proportion relative to said basic injection amount, modify said learned multiplication term and said learned addition term such that the sum of said proportion and said learned multiplication term, is within a preset first range (RLRMAX#, RLRMIN#), calculate a target fuel injection amount based on said basic injection amount and said modified multiplication term and said modified addition term, and control said fuel injector so that an injection amount of said fuel injector coincides with said target injection amount.

18. An air-fuel ratio controller as defined in claim 17, wherein said microprocessor is programmed to learn said multiplication term for each of plural running regions determined according to said engine load and said engine rotation speed, modify said learned addition term such that said learned addition term lies within a second range (LTSMAX2, LTSMIN2), determine said proportion based on a value obtained by dividing said modified addition term by a minimum value of said basic injection amount in a running region, and modify said multiplication term such that the sum of said proportion and said multiplication term lies within said first range (RLRMAX#, RLRMIN#).

19. An air-fuel ratio controller as defined in claim 17, wherein said microprocessor is programmed to learn said multiplication term for each of plural running regions determined according to said engine load and said engine rotation speed, modify said learned addition term such that said learned addition term lies within a second range (LTSMAX2, LTSMIN2), determine said proportion based on a value obtained by dividing said modified addition term by a minimum value of said basic injection amount in a running region, and modify said multiplication term such that the sum of said proportion and said multiplication term lies within said first range (RLRMAX#, RLRMIN#), and such that said multiplication term lies within said first range (RLRMAX#, HLRMIN#).

* * * * *